US012089675B2

(12) United States Patent
Obama et al.

(10) Patent No.: US 12,089,675 B2
(45) Date of Patent: Sep. 17, 2024

(54) HAIR FEEDING DEVICE

(71) Applicants: JUKI CORPORATION, Tama (JP); ARTNATURE INC., Tokyo (JP)

(72) Inventors: Jiro Obama, Tokyo (JP); Hideki Iijima, Tokyo (JP); Toru Ichita, Tokyo (JP); Honoka Iimura, Tokyo (JP)

(73) Assignees: JUKI CORPORATION, Tama (JP); ARTNATURE INC., Tokyo (JP)

( * ) Notice: Subject to any disclaimer, the term of this patent is extended or adjusted under 35 U.S.C. 154(b) by 936 days.

(21) Appl. No.: 17/097,402

(22) Filed: Nov. 13, 2020

(65) Prior Publication Data

US 2021/0145101 A1 May 20, 2021

(30) Foreign Application Priority Data

Nov. 15, 2019 (JP) ..... 2019-206747

(51) Int. Cl.
*A41G 3/00* (2006.01)

(52) U.S. Cl.
CPC ..... *A41G 3/0075* (2013.01)

(58) Field of Classification Search
CPC ..... D05C 15/02; D01G 19/08; D01G 19/10; D01G 19/12; D01G 19/14; D01G 19/16; D01G 19/18; D01G 19/105; D01G 19/06; D01G 19/00; D01G 5/00; D01G 7/00; D01G 11/00; D01G 9/00; D01G 9/04; D01G 9/12; D01G 9/14; D01G 9/16; D01G 15/04; A41G 3/0075
(Continued)

(56) References Cited

U.S. PATENT DOCUMENTS 2,686,305 A 8/1954 Hall
3,013,567 A 12/1961 Sotzky
(Continued)

FOREIGN PATENT DOCUMENTS

JP S63-219666 A 9/1988
JP 2018-040084 A 3/2018
WO WO-0144552 A1 * 6/2001 ..... A41G 3/0066

OTHER PUBLICATIONS

Machine translation—WO01/44552 (Year: 2001).*
(Continued)

*Primary Examiner* — Khoa D Huynh
*Assistant Examiner* — Uyen T Nguyen
(74) *Attorney, Agent, or Firm* — Faegre Drinker Biddle & Reath LLP

(57) ABSTRACT

In a hair feeding device configured to perform a feeding operation for pulling out flocking hairs one by one from a bundle of flocking hairs, the device includes: a feeder configured to hold the bundle of flocking hairs and separates hair ends of a plurality of the flocking hairs in a direction different from that of the bundle; a head configured to hold the hair ends of the flocking hairs; a conveyance mechanism configured to convey the head; and a control device configured to perform an operation control of the feeding operation, and the feeder includes a bundle holder configured to hold the bundle of flocking hairs, and a separator configured to separate a plurality of the flocking hairs from the bundle of flocking hairs held by the bundle holder in a state where the hair ends are oriented in a direction different from that of the bundle.

5 Claims, 16 Drawing Sheets

(58) Field of Classification Search
USPC ..... 19/80 A, 83, 86, 96, 97.5
See application file for complete search history.

(56) References Cited

U.S. PATENT DOCUMENTS

| | | | | | |
|---|---|---|---|---|---|
| 5,257,438 | A * | 11/1993 | Faas | D01G 13/00 | 19/145.5 |
| 5,396,758 | A * | 3/1995 | Spindler | D01H 4/48 | 57/263 |
| 2004/0250829 | A1* | 12/2004 | Fukuyama | A41G 3/0075 | 132/56 |
| 2009/0000069 | A1* | 1/2009 | Saeger | D01G 19/08 | 19/115 R |
| 2009/0000079 | A1* | 1/2009 | Bossmann | D01G 19/08 | 19/80 A |

OTHER PUBLICATIONS

Japanese Office Action issued May 16, 2023 in Application No. 2019-206747.
Extended European Search Report issued on Apr. 7, 2021 in corresponding European patent application No. 20207690.7 (5 pages).

* cited by examiner

HAIR FEEDING DEVICE

CROSS-REFERENCE TO RELATED APPLICATIONS

The present application claims the benefit of priority of Japanese Patent Application No. 2019-206747, filed on Nov. 15, 2019, the content of which is incorporated herein by reference.

TECHNICAL FIELD

The present invention relates to a hair feeding device.

BACKGROUND ART

In recent years, a hair flocking device has been developed in which a plurality of hook needles are used to form a knot of flocking hair in each mesh hole of a mesh-shaped base material for performing hair flocking, and the automation of wig manufacturing has been promoted (for example, refer to Japanese Unexamined Patent Application Publication No. 2018-040084).

SUMMARY OF INVENTION

With the above-described hair flocking device, it is possible to automate the hair flocking work that has been conventionally performed manually, and to stably and continuously perform hair flocking on the base material.

However, the hair flocking device needs to be fed with flocking hairs one by one, and stable and continuous feeding of the flocking hair is indispensable for realizing stable and continuous hair flocking work.

In general, since a large number of flocking hairs is required in the hair flocking work, the hairs are distributed in a bundled state. Therefore, it is required to take out the flocking hairs one by one from such a bundle of flocking hairs and properly feed the hairs to the hair flocking device, but the automation of such feeding work has not been realized.

An object of the present embodiment is to feed flocking hairs one by one from a bundle of flocking hairs.

According to the first aspect of the invention, there is provided a hair feeding device configured to perform a feeding operation for pulling out flocking hairs one by one from a bundle of flocking hairs, the device including: a feeder configured to hold the bundle of flocking hairs and separates hair ends of a plurality of the flocking hairs in a direction different from that of the bundle; a head that holds the hair ends of the flocking hairs; a conveyance mechanism configured to convey the head; and a control device configured to perform an operation control of the feeding operation, in which the feeder includes a bundle holder that holds the bundle of flocking hairs, and a separator configured to separate a plurality of the flocking hairs from the bundle of flocking hairs held by the bundle holder in a state where the hair ends are oriented in a direction different from that of the bundle.

According to the second aspect of the invention, in the hair feeding device according to the first aspect, the bundle holder may include an abutting member in which the bundle of flocking hairs is pressed against and held on two abutting surfaces that intersect each other with a gradual decrease in distance, and the separator may include a separation plate that is inserted from an outer periphery of the bundle of flocking hairs and separates the plurality of the flocking hairs.

According to the third aspect of the invention, in the hair feeding device according to the second aspect, the separation plate may make the plurality of the flocking hairs oriented in a direction different from that of the bundle by an operation of rotating a flat plate surface in a state of being inserted into the bundle of flocking hairs.

According to the fourth aspect of the invention, in the hair feeding device according to the third aspect, the separation plate may include a recess portion configured to allow a state where the hair ends of each of the plurality of the separated flocking hairs are widened on the flat plate surface.

According to the fifth aspect of the invention, in the hair feeding device according to the third or fourth aspect, an air nozzle configured to blow air onto the flat plate surface that is in contact with the plurality of the flocking hairs after the rotation of the separation plate may further be provided.

In the present invention, since the separator separates the plurality of flocking hairs from the bundle of flocking hairs held by the bundle holder in the direction different from that of the bundle, it is possible to easily pull out one flocking hair from the plurality of flocking hairs, and to properly feed the flocking hairs one by one from the bundle of the flocking hairs.

DESCRIPTION OF EMBODIMENTS

[Overall Configuration of Embodiment]

Hereinafter, a hair feeding device 10 according to an embodiment of the invention will be described in detail with reference to the drawings.

Figure 1:
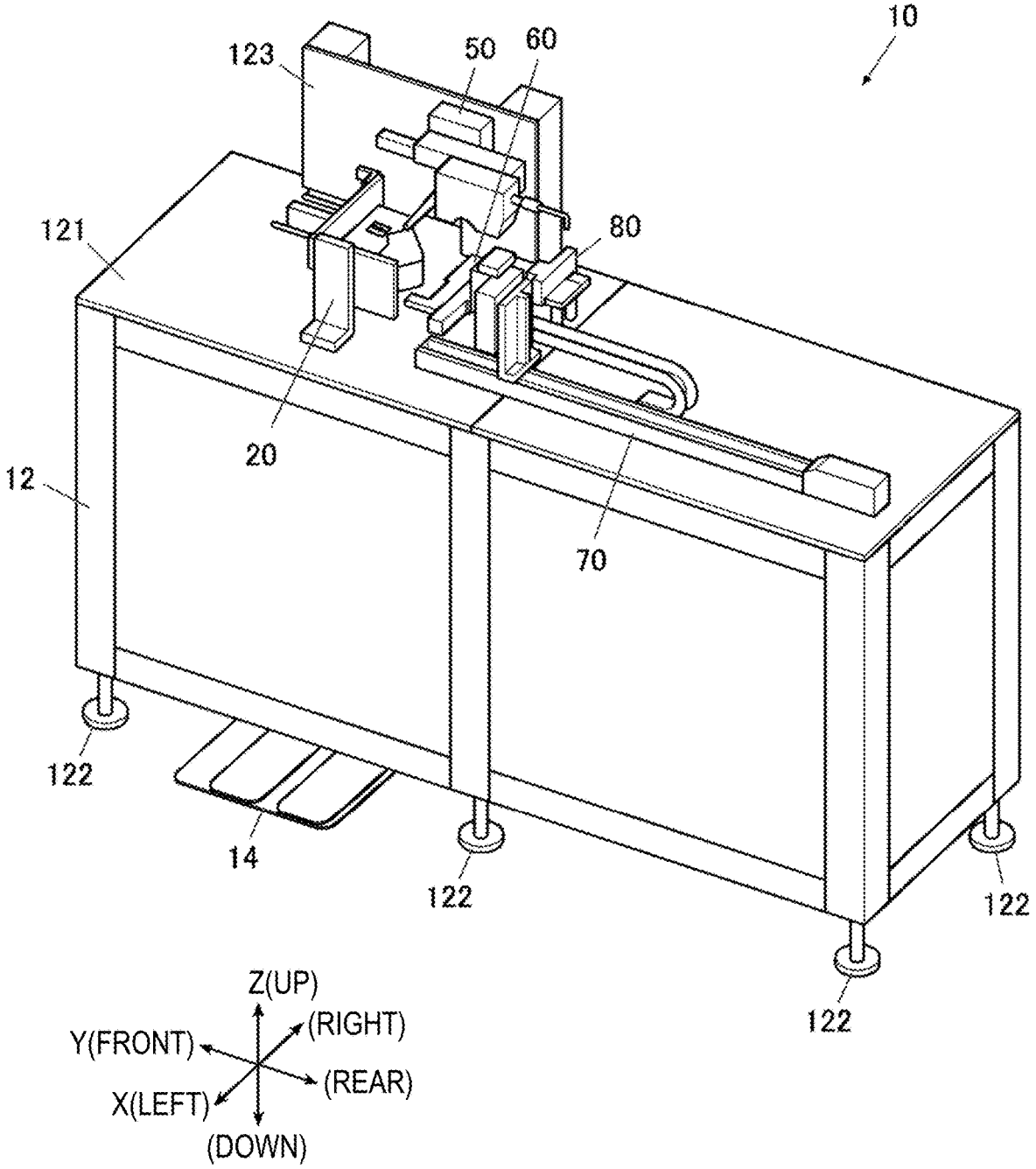
FIG. 1 is a perspective view illustrating an overall configuration of a hair feeding device according to an embodiment of the invention.
Figure 2:
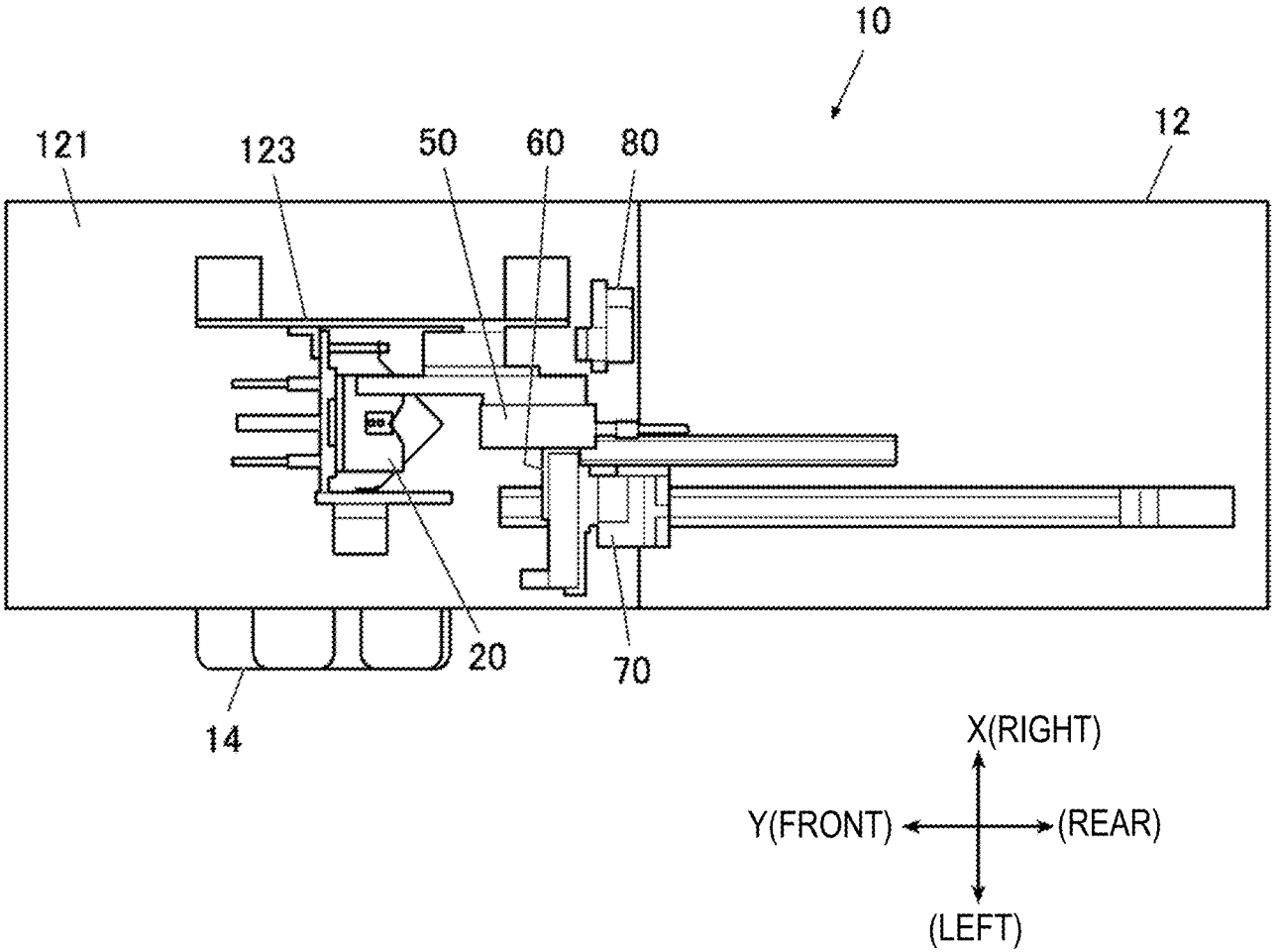
FIG. 2 is a plan view illustrating the overall configuration of the hair feeding device.
Figure 3:
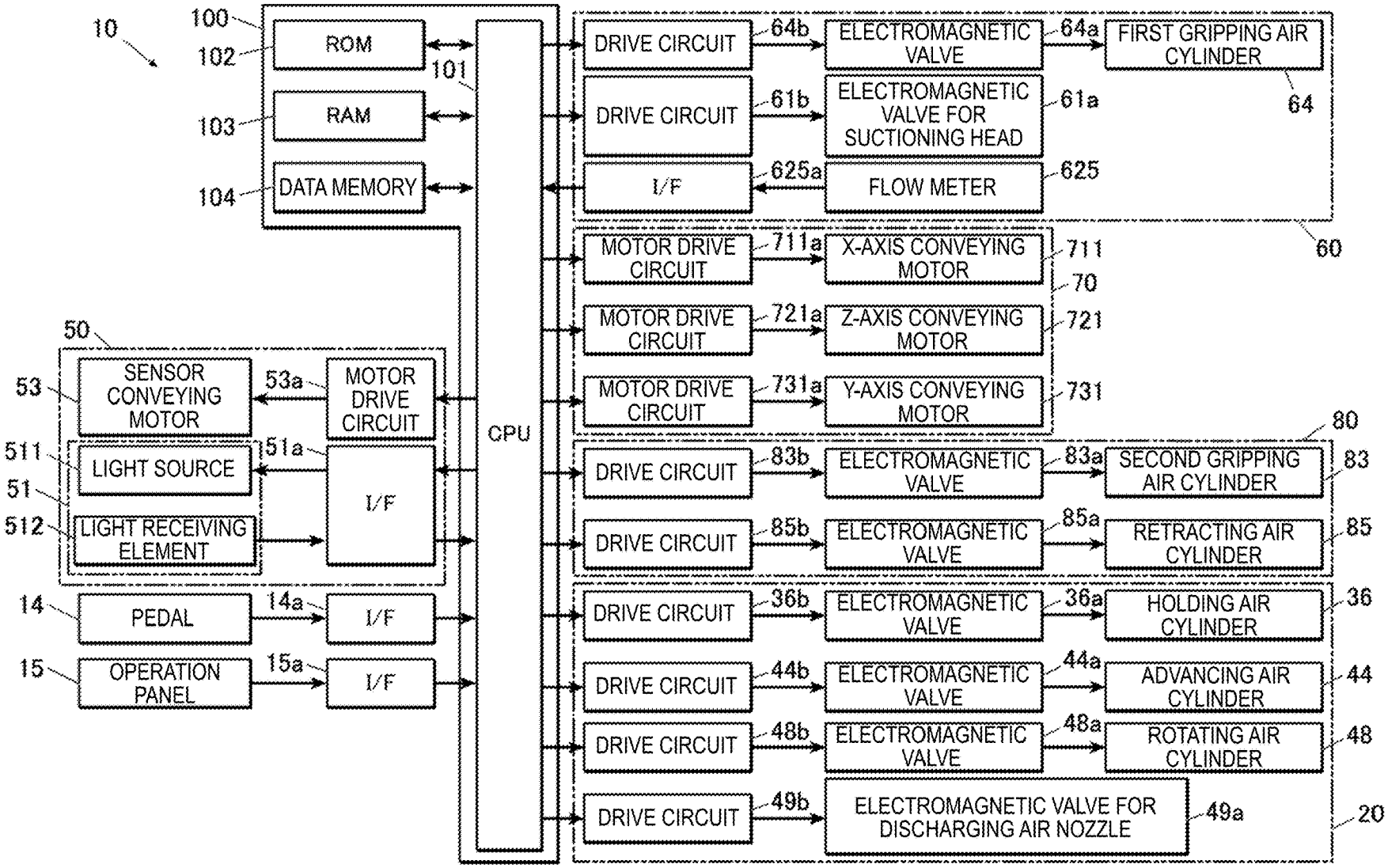
FIG. 3 is a block diagram illustrating a control system of the hair feeding device.

FIG. 1 is a perspective view illustrating the overall configuration of the hair feeding device 10, FIG. 2 is a plan view illustrating the overall configuration of the hair feeding device 10, and FIG. 3 is a block diagram illustrating a control system thereof.

The hair feeding device 10 is for automatically taking out and feeding flocking hairs M one by one from a bundle B of the flocking hairs M, to a hair flocking device (not illustrated).

The flocking hair M is not limited to human hair, but targets all other fibers that are similar to human hair, including natural fibers and artificial fibers.

As illustrated in the drawing, the hair feeding device 10 includes: a feeder 20 that separates hair ends of the plurality of flocking hairs M, which is a part of the bundle B of the flocking hairs M, in a direction (for example, toward a head 60 which will be described later) different from that of the bundle B; a detector 50 that detects three-dimensional positions of the separated hair ends of the plurality of flocking hairs; the head 60 for capturing the hair end of one flocking hair M; a conveyance mechanism 70 that conveys the head 60 to any three-dimensional position; a gripping device 80 which is a holding unit that holds an end portion on the opposite side of the hair end of the flocking hair M pulled out by the head 60; a pedal 14 that executes a feeding operation of the flocking hair M; a control device 100 that performs an operation control of the feeding operation of the flocking hair M; and a base 12 that supports each of the above-described configurations.

In the following description, as illustrated in FIG. 1, the device is horizontal in a state of being installed on the horizontal surface, two directions orthogonal to each other are the X-axis direction and the Y-axis direction, and one side of the X-axis direction is "left" side and the other one side is "right" side, and one side of the Y-axis direction is "front" side and the other one side is "rear" side. The perpendicular up-down direction orthogonal to the X-axis direction and the Y-axis direction is the Z-axis direction, one side of the Z-axis directions is the "upper" side and the other one side is "lower" side.

[Base]

The base 12 has a substantially rectangular parallelepiped shape, and the upper surface thereof is a horizontal surface along the X-Y plane. A long rectangular support plate 121 is provided on the upper surface of the base 12 along the Y-axis direction, and each configuration of the hair feeding device 10 is placed and supported on the upper surface of the support plate 121.

On the bottom portion of the base 12, six supporting legs 122 (two are not illustrated) are provided, but on the bottom portion of the base 12, a caster that can move the device may be provided.

[Feeder]

Figure 4:
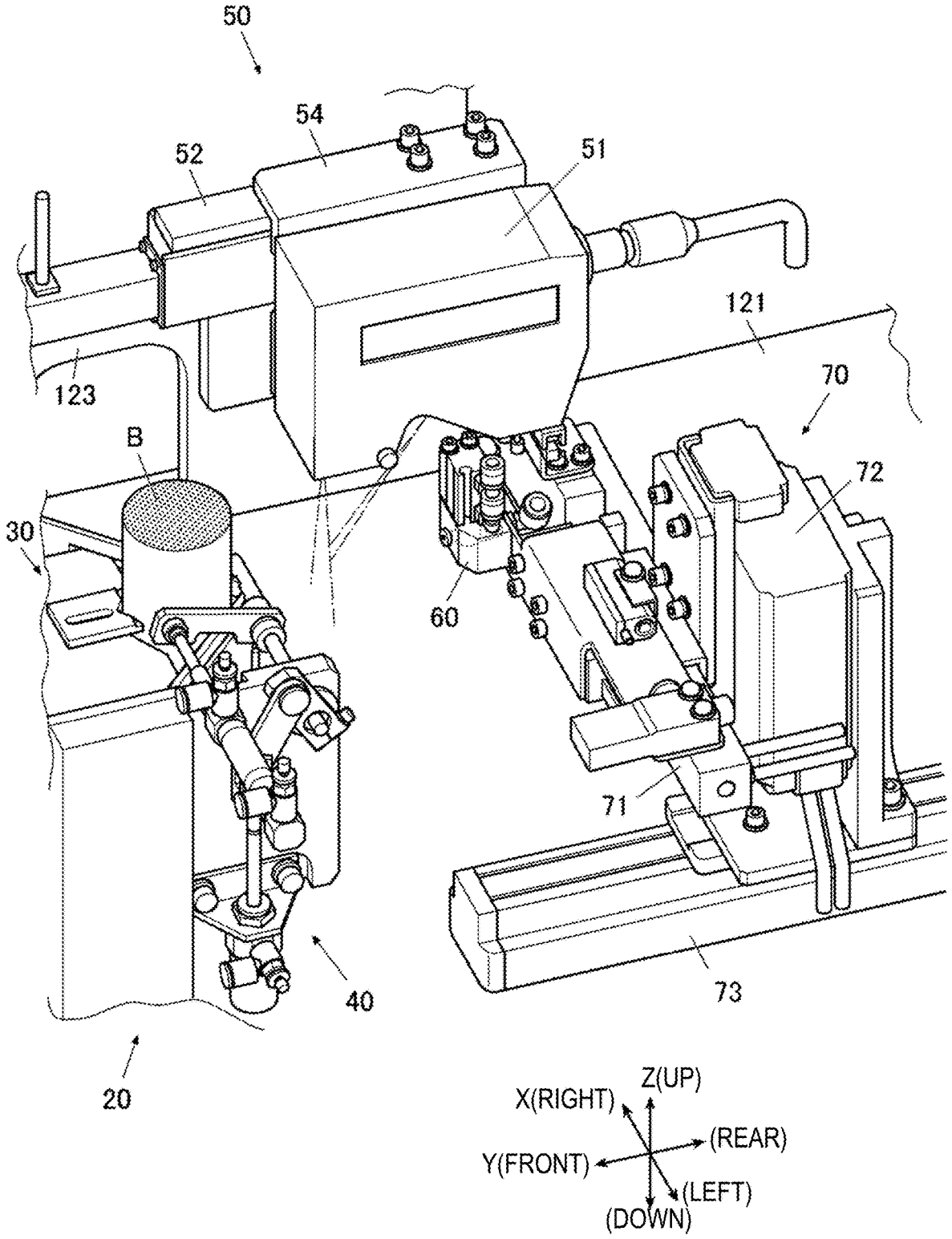
FIG. 4 is a perspective view of a configuration on a support plate of the hair feeding device.
Figure 5:
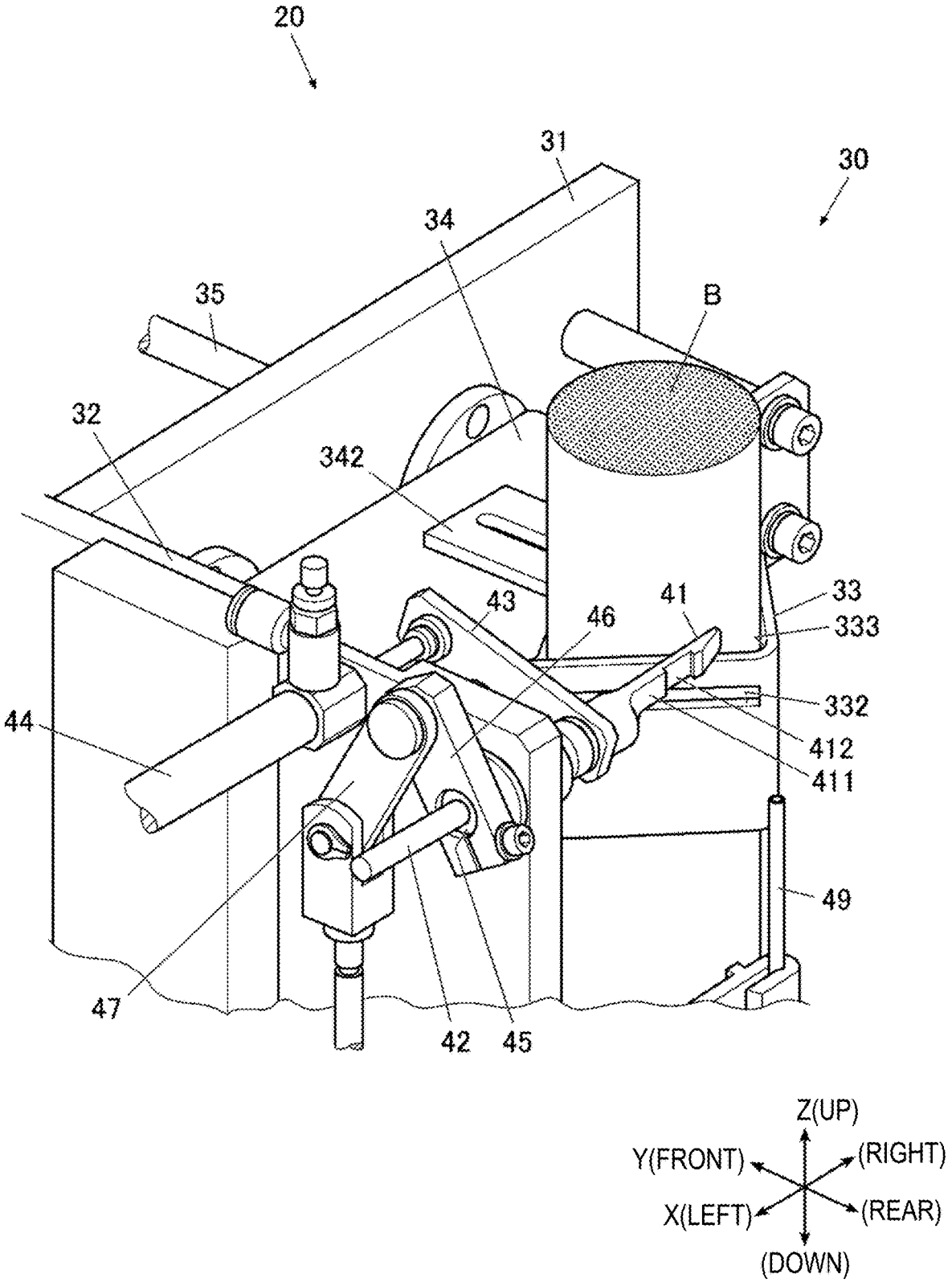
FIG. 5 is a perspective view of a feeder in which a separation plate is in a standby state.
Figure 6:
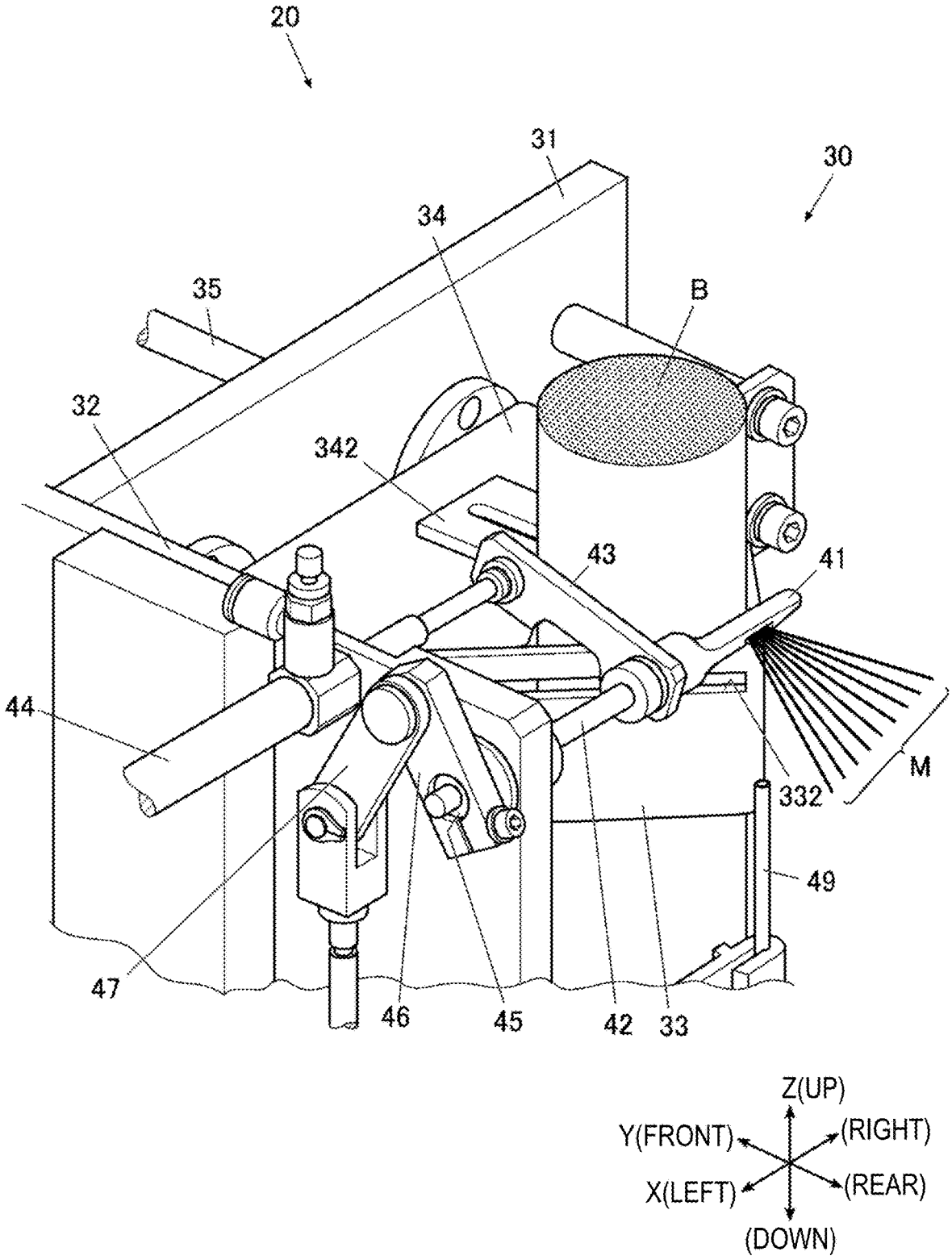
FIG. 6 is a perspective view of the feeder in which the separation plate is in a tilted state.
Figure 7:
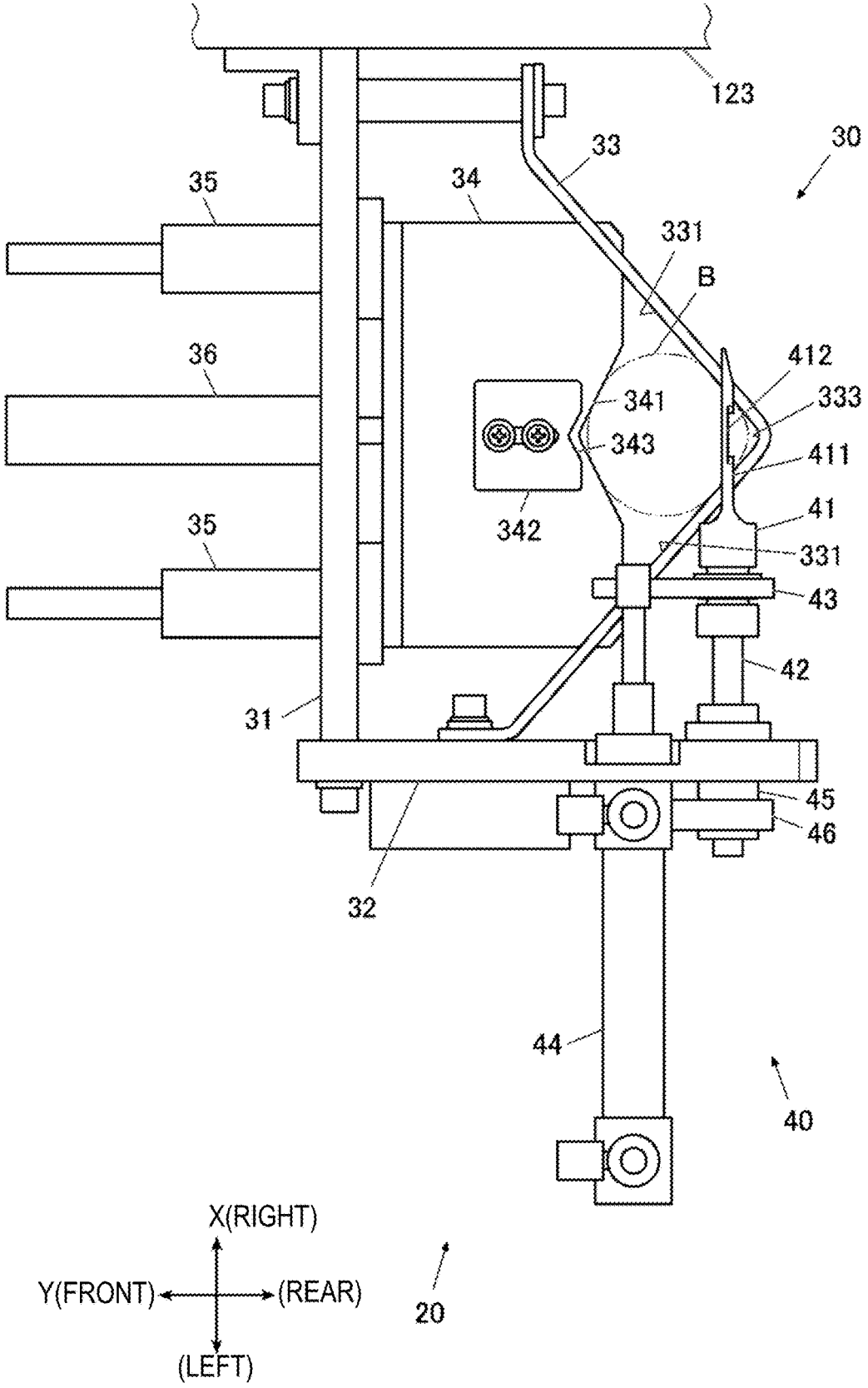
FIG. 7 is a plan view of the feeder.

FIG. 4 is a perspective view of each configuration on the support plate 121, FIGS. 5 and 6 are perspective views of the feeder 20, and FIG. 7 is a plan view.

As illustrated in FIGS. 4 to 7, the feeder 20 is installed at the front part of the upper surface of the support plate 121. The feeder 20 includes: a bundle holder 30 that holds the bundle B of the flocking hairs M; and a separator 40 that separates the plurality of flocking hairs M from the bundle B of the flocking hairs M held by the bundle holder 30 in a state where the hair ends are oriented in a predetermined direction (toward the head 60, for example, rearward).

In the bundle B of the flocking hairs M, hundreds to thousands of flocking hairs M having a uniform length are bundled in a substantially columnar shape.

The bundle holder 30 includes: a main body plate 31 of which the right end portion is supported by a support wall 123 erected along the Y-Z plane at a position near the right end portion of the upper surface on the support plate 121; and a side wall plate 32 connected to the left end portion of the main body plate 31.

The main body plate 31 is a rectangular flat plate along the X-Z plane, and the side wall plate 32 is a flat plate along the Y-Z plane that extends rearward from the left end portion of the main body plate 31. The side wall plate 32 includes a leg portion and is erected on the upper surface of the support plate 121.

The bundle holder 30 includes: a receiving plate 33 which is an abutting member that is provided behind the main body plate 31 and supports the bundle B of the flocking hairs M; and a pressure plate 34 that presses the bundle B of the flocking hairs M against the receiving plate 33 side.

The receiving plate 33 is curved in a substantially V shape in a plan view, and is supported by the main body plate 31 and the side wall plate 32 so that the V-shaped opening portion is oriented forward.

The receiving plate 33 has two abutting surfaces 331 of which the distance therebetween gradually decreases rearward inside the V-shape. All of the abutting surfaces 331 are perpendicular to the X-Y plane and intersect at a V-shaped valley part, and the intersection part of the two abutting surfaces 331 is along the Z-axis direction. The bundle B of the flocking hairs M is pressed against the V-shaped valley part, and accordingly, the bundle B of the flocking hairs M is held along the Z-axis direction.

The pressure plate 34 is a rectangular flat plate along the X-Y plane, and a substantially V-shaped cutout portion 341 is formed at the center of the rear end portion thereof. The front end portion of the pressure plate 34 is slidably supported along the Y-axis direction by two slide guides 35 provided on the main body plate 31 at both the left and right end portions. The pressure plate 34 is connected to a plunger of the holding air cylinder 36 fixedly mounted on the main body plate 31, and is give a reciprocating movement operation along the Y-axis direction.

Both the left and right end portions of the rear end portion of the pressure plate 34 can be inserted into slit holes 332 parallel to the X-Y plane formed on the two abutting surfaces 331 of the receiving plate 33, respectively. Accordingly, the rear end portion of the pressure plate 34 can retreat to the vicinity of the V-shaped valley of the receiving plate 33.

The valley part of the substantially V-shaped cutout portion 341 formed at the rear end portion of the pressure plate 34 and the substantially V-shaped valley part of the receiving plate 33 described above are arranged in the X-axis direction while matching each other.

Therefore, when the pressure plate 34 is pressurized in the retreat moving direction by the holding air cylinder 36, the flocking hairs M arranged at the substantially V-shaped valley part of the receiving plate 33 is pressurized and held in a state of being fitted into the valley part of the substantially V-shaped cutout portion 341 of the pressure plate 34.

The bundle B of the flocking hairs M held by the bundle holder 30 is taken out in order from the rear part (the part on the two abutting surfaces 331 sides) and fed to the feeding destination. Therefore, in the bundle B of the flocking hairs M, the number of flocking hairs M gradually decreases, and the sectional area thereof gradually decreases.

When the sectional area of the bundle B of the flocking hairs M becomes smaller, it becomes difficult to hold the bundle B between the substantially V-shaped valley part of the receiving plate 33 and the substantially V-shaped valley part of the cutout portion 341 of the pressure plate 34.

Therefore, the upper surface of the pressure plate 34 is equipped with an auxiliary pressure plate 342 having a small width in the X-axis direction. Similar to the pressure plate 34, the auxiliary pressure plate 342 includes a small substantially V-shaped cutout portion 343 formed at the rear end portion. The auxiliary pressure plate 342 includes a slot formed along the Y-axis direction and is fixed to the pressure plate 34 by a locking screw. Therefore, with respect to the pressure plate 34, the auxiliary pressure plate 342 can move along the Y-axis direction to adjust the fixing position.

Since the width of the auxiliary pressure plate 342 in the X-axis direction is smaller, the rear end portion thereof can be brought closer to the receiving plate 33 side. Therefore, if the sectional area of the bundle B of the flocking hairs M becomes small, the position is adjusted so that the rear end portion of the auxiliary pressure plate 342 is behind the rear end portion of the pressure plate 34, and accordingly, it becomes possible to hold the bundle B of the flocking hairs M having a reduced number of hairs.

The separator 40 includes a separation plate 41 that is inserted from the outer periphery of the bundle B of the flocking hairs M and separates the plurality of flocking hairs M in a state where the hair ends are oriented rearward.

Figure 8:
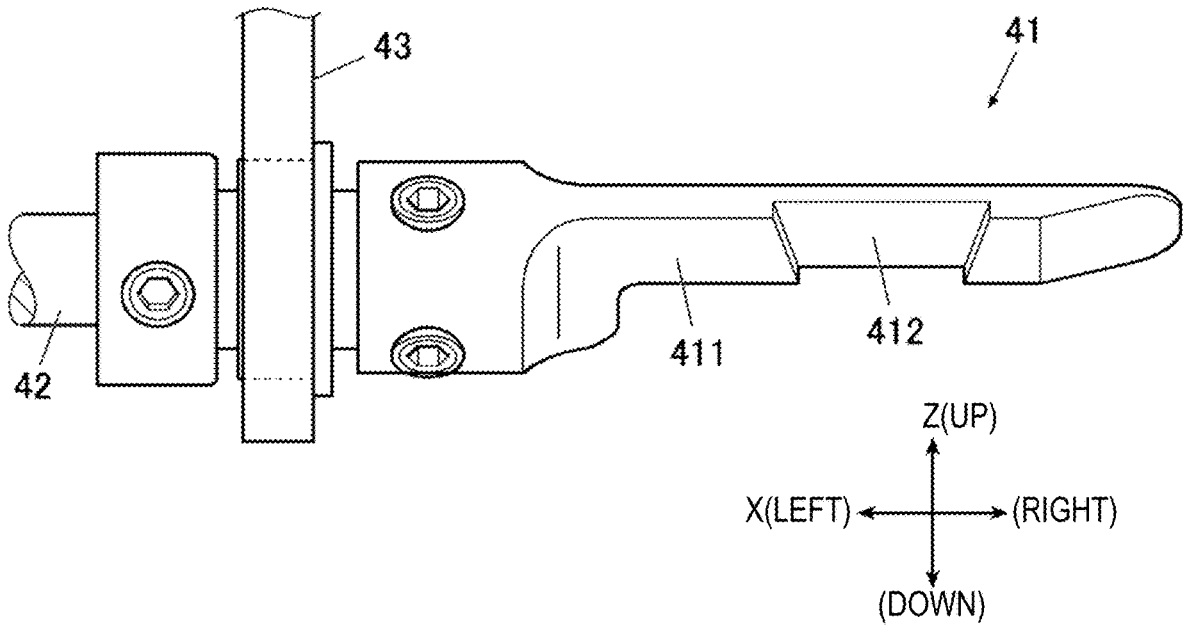
FIG. 8 is an enlarged view of the separation plate.
Figure 9:
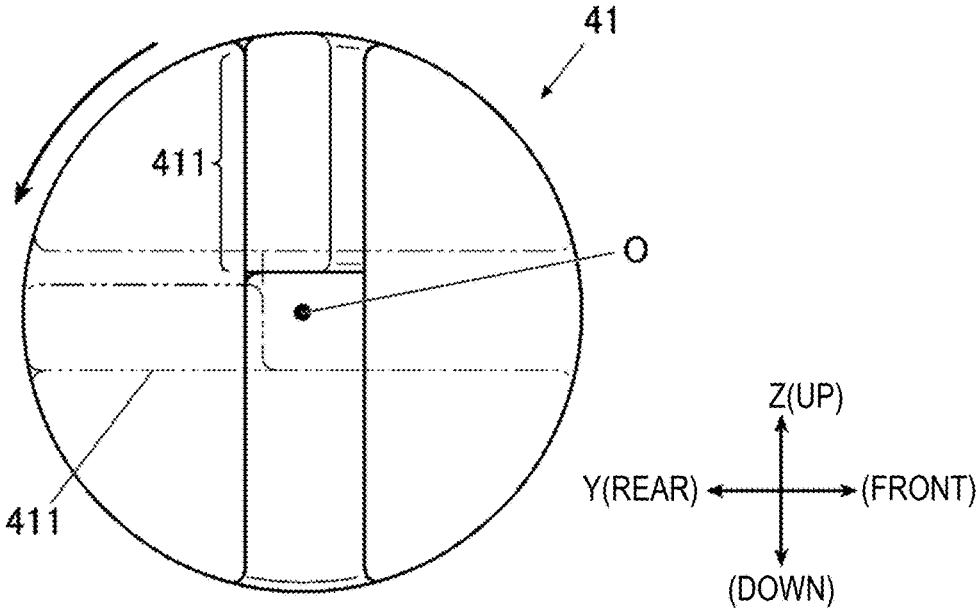
FIG. 9 is a view of the separation plate viewed from the right.

FIG. 8 is an enlarged view of the separation plate 41, and FIG. 9 is a view of the separation plate 41 viewed from the right. The separation plate 41 is a long flat plate having a flat plate surface parallel to the X-axis direction and long along the X-axis direction, and the tip end portion thereof extends rightward. The tip end portion of the separation plate 41 has a thin wedge shape, and can penetrate the outer periphery of the held bundle B of the flocking hairs M in a state where a flat plate surface 411 of the separation plate 41 is along the X-Z plane.

The separation plate 41 is fixedly supported at the right end portion of a support shaft 42 along the X-axis direction. The support shaft 42 is supported with respect to the side wall plate 32 to be rotatable around the X axis and slidable along the X-axis direction.

The separation plate 41 stands by on the left side of the bundle B of the flocking hairs M (in a standby state) in a state where the flat plate surface is along the X-Z plane, advances from a standby state to the right side, and accordingly, is inserted into the bundle B of the flocking hairs M (in an advanced state).

The bundle B of the flocking hairs M is pushed close to the bottom portion (referred to as a narrow portion 333) of the valley part by the two abutting surfaces 331 of the receiving plate 33 by the pressing force from the pressure plate 34, and the separation plate 41 is inserted into the bundle B of the flocking hairs M immediately above the receiving plate 33, that is, slightly in front of the narrow portion 333 of the receiving plate 33 in a plane view. Therefore, the separation plate 41 can perform "small number separation" in which only a few flocking hairs M that have entered the narrow portion 333 of the receiving plate 33 are separated behind the separation plate 41.

The separation plate 41 can rotate around the X axis together with the support shaft 42, and in an advanced state, the rotation operation by 90° is given in the clockwise direction when viewed from the left side. Here, since the separation plate 41 is positioned immediately above the receiving plate 33, as illustrated in FIG. 6, several flocking hairs M separated on the rear side are pushed down by 90° in the clockwise direction when viewed from the left side by the flat plate surface 411 of the separation plate 41, and are in a state where the hair end of the upper end portion is oriented rearward (in a tilted state).

Here, as illustrated in FIG. 9, the flat plate surface 411 of the separation plate 41 is arranged offset with respect to a rotation center O by the support shaft 42. In other words, in a state immediately after advancing, the flat plate surface 411 of the separation plate 41 is positioned on the outer side in the radial direction around the rotation center O, that is, above the rotation center O, and moves on the rear side of the rotation center O in a tilted state (illustrated by a two-down chain line). Therefore, the tip end portion on the outer side in the radial direction of the flat plate surface 411 of the separation plate 41 can be moved further rearward at the time of tilting, and the flocking hair M separated by the small number separation can be effectively pushed down rearward.

When at least the rear end portion of the flat plate surface 411 of the separation plate 41 at the time of tilting, more preferably the entire part is behind the narrow portion 333 in a plane view, the separated flocking hair M can be oriented rearward more effectively. It is preferable that the lower surface (flat plate surface 411) of the separation plate 41 at the time of tilting is lowered to the same height as or closer to the upper end portion of the receiving plate 33.

The offset arrangement of the flat plate surface 411 of the separation plate 41 prevents the forward protrusion from the rotation center O when being tilted, and it is possible to prevent interference with the bundle B of the flocking hairs M at the part in front of the rotation center O, and to ensure the smooth rotation operation of the separation plate 41.

The separation plate 41 may be offset below the rotation center O immediately after advancing, and may be rotated by 90° in the counterclockwise direction when viewed from the left side. Here, the flocking hair M separated by the small number separation can be tilted rearward to be kicked.

The separation plate 41 is not limited to the rotary type, but may be configured to be inserted into the bundle B of the flocking hairs M along the X-Z plane, move in parallel rearward as it is, and tilt a small number of separated flocking hairs M rearward between the lower end portion of the separation plate 41 and the upper end portion of the receiving plate 33.

Figure 10:
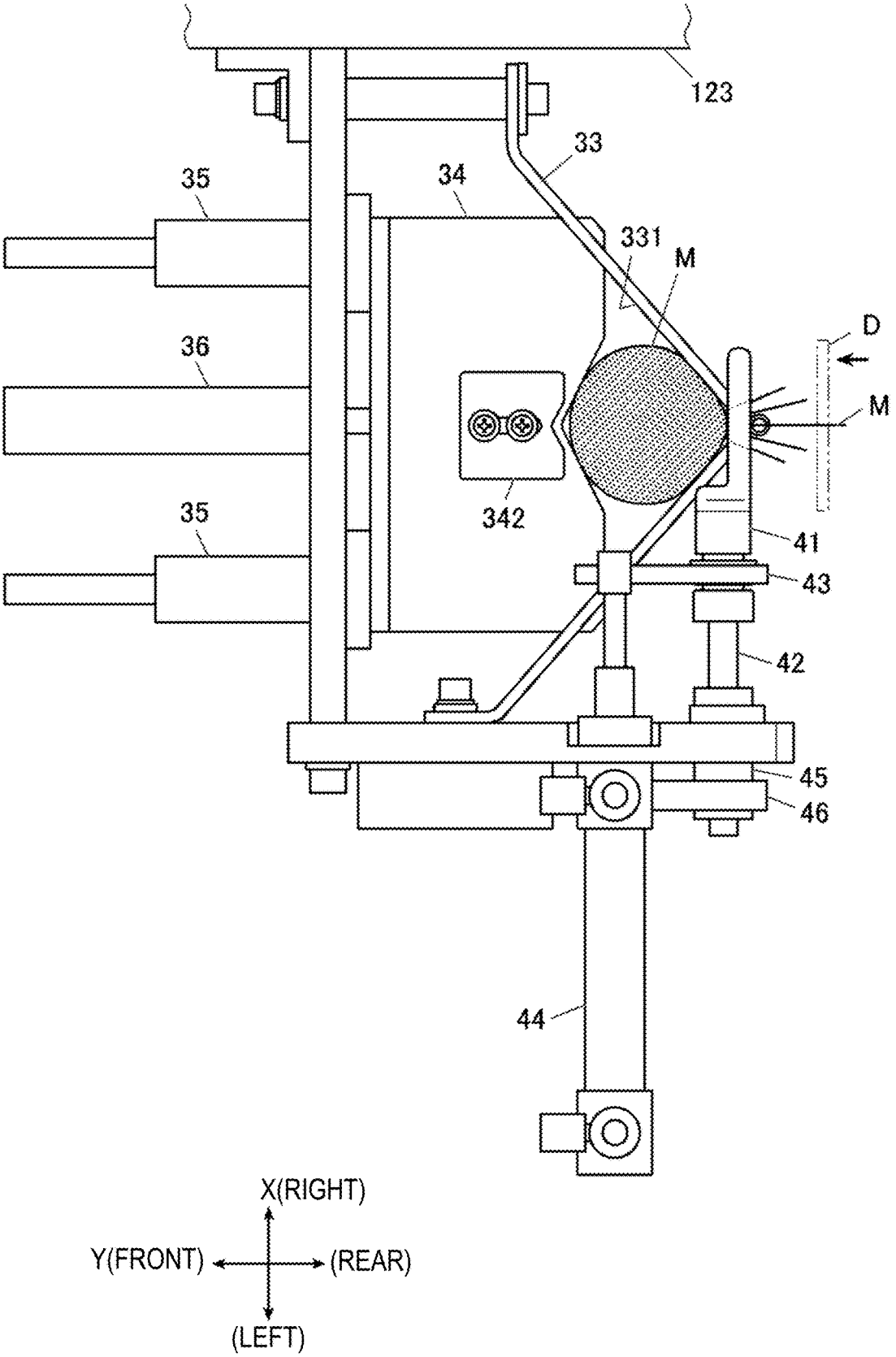
FIG. 10 is a plan view of the feeder in which the separation plate is in a tilted state.

On the flat plate surface 411 of the separation plate 41, a recessed groove 412 as a recess portion that allows a state where the separated hair ends of each of the plurality of flocking hairs M are widened. As illustrated in FIG. 8, the recessed groove 412 is a groove that is in a state along the up-down direction when the separation plate 41 is not in a tilted state (a normal state (a state immediately after advancing described above)), and has a shape of which the width gradually increases upward from below. Therefore, when the separation plate 41 is rotated to be in a tilted state, the recessed groove 412 is in a state of widening rearward, and a state where the hair ends of the plurality of flocking hairs M pushed down in the recessed groove 412 are widened rearward in the angle range of the recessed groove 412 as illustrated in FIG. 10, is allowed.

The support shaft 42 that supports the separation plate 41 is connected to a connecting plate 43 in the vicinity of the right end portion.

The connecting plate 43 is connected to the plunger of an advancing air cylinder 44 fixedly supported on the front side of the support shaft 42 by the side wall plate 32. The advancing air cylinder 44 is fixedly supported by the side wall plate 32 so that the plunger reciprocates left and right. Therefore, by operating the advancing air cylinder 44, the separation plate 41 can be advanced to the right via the connecting plate 43, and a standby state can be switched to an advanced state. The advancing air cylinder 44 can switch the separation plate 41 from an advanced state to a standby state.

The support shaft 42 is supported by the side wall plate 32 via a spline nut 45. The spline nut 45 is rotatably supported around the X axis with respect to the side wall plate 32. The spline nut 45 performs interlocking rotation around the X axis together with the support shaft 42 while allowing the sliding operation of the support shaft 42 along the X-axis direction.

Figure 11:
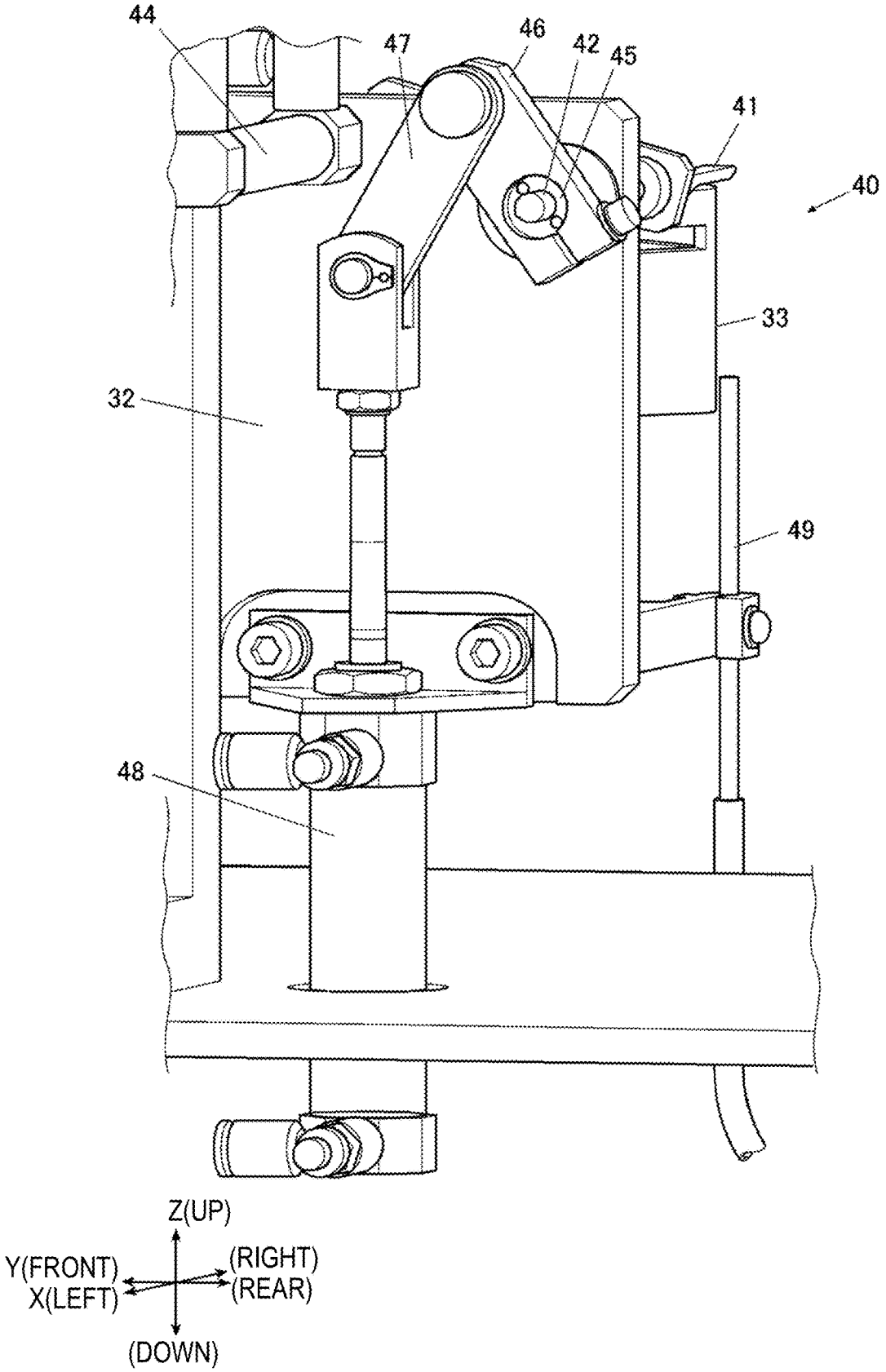
FIG. 11 is a perspective view of a configuration in which the separation plate is rotated.

As illustrated in FIG. 11, the spline nut 45 is hugged and fixed to one end portion of a driven arm 46, and the other end portion of the driven arm 46 is connected to the plunger of a rotating air cylinder 48 via a link member 47.

The driven arm 46 is rotatable around the X axis with the spline nut 45 as the shaft, and the link member 47 is connected to the driven arm 46 and the plunger of the rotating air cylinder 48 of which both the end portions can rotate around the X axis, respectively.

The rotating air cylinder 48 is attached to the side wall plate 32 while the plunger is oriented upward. When the plunger of the rotating air cylinder 48 is advanced upward, the driven arm 46 can be rotated by 90° in the clockwise direction when viewed from the left together with the spline nut 45 and the support shaft 42 via the link member 47.

Therefore, the rotating air cylinder 48 can switch the separation plate 41 in an advanced state to a tilted state. The rotating air cylinder 48 can return the separation plate 41 from a tilted state to the normal state.

An air nozzle 49 is provided below the rear end portion of the receiving plate 33. The air nozzle 49 is arranged below the recessed groove 412 of the flat plate surface 411 of the tilted separation plate 41 in a state where the nozzle tip end portion is oriented upward, and the air can be blown to the recessed groove 412. The air nozzle 49 is connected to a high-pressure air feed source (not illustrated), and the air can be blown at a predetermined timing by controlling an electromagnetic valve 49*a* (refer to FIG. 3).

The air nozzle 49 can disperse the plurality of flocking hairs M pushed down in the recessed groove 412 to not make the hairs overlap each other, by blowing the air from below onto the recessed groove 412 of the flat plate surface 411 of the tilted separation plate 41.

[Detector]

As illustrated in FIG. 4, the detector 50 is supported by the support wall 123 and is arranged behind the feeder 20. The detector 50 includes a displacement sensor 51 and a conveying unit 52 that conveys the displacement sensor 51 along the Y-axis direction.

The conveying unit 52 includes, for example, a ball screw mechanism and a sensor conveying motor 53 (refer to FIG. 3) as a driving source thereof.

By driving the sensor conveying motor 53, the ball screw of the ball screw mechanism is rotated, a bracket 54 that supports the displacement sensor 51 is moved along the Y-axis direction, and the displacement sensor 51 can be moved and positioned at any position in the Y-axis direction.

The conveying unit 52 may use a well-known linear motion mechanism other than the ball screw mechanism, as long as the displacement sensor 51 can be moved and positioned at any position in the Y-axis direction.

Figure 12:
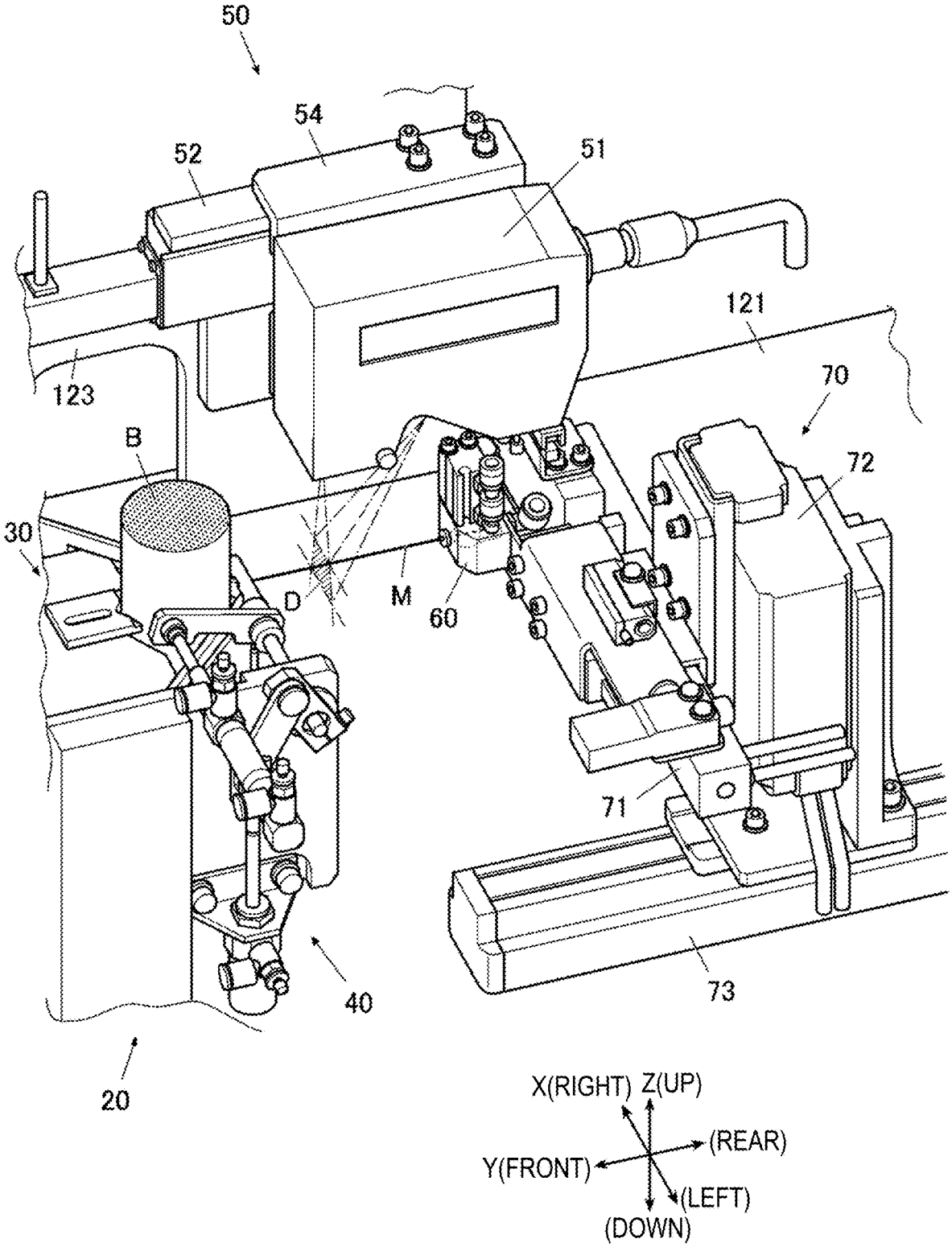
FIG. 12 is a perspective view of a configuration on the support plate of the hair feeding device in a state where a head pulls out one flocking hair.

FIG. 12 is a perspective view illustrating a detection region D of the displacement sensor 51.

The displacement sensor 51 includes a light source 511 of detected light and a light receiving element 512 (refer to FIG. 3) that receives the reflected light.

As illustrated in FIG. 12, the light source 511 of the displacement sensor 51 emits a detected light formed of laser light vertically downward along the X-Z plane.

Meanwhile, the light receiving element 512 is a planar image sensor, and in the light receiving element 512 and an optical system (not illustrated), the optical axis is tilted slightly forward with respect to the vertically downward direction, and the detection range has some width in the X-axis direction and the Y-axis direction.

Therefore, the detection region D of the displacement sensor 51 is a region (the trapezoidal region illustrated by the diagonal line in FIG. 12) along the X-Z plane that overlaps the detection range of the light receiving element 512 for the detected light along the X-Z plane.

The displacement sensor 51 can detect an intersection position on the detection region D by generating scattered light when the flocking hair M intersects the planar detection region D. In other words, the displacement sensor 51 configures a sensor that detects a two-dimensional position along the X-Z plane.

Since the displacement sensor 51 can be moved along the Y-axis direction orthogonal to the detection region D by the conveying unit 52, by scanning the detection region D along the Y-axis direction, it is possible to detect the three-dimensional position of the flocking hair M.

For example, as illustrated in FIG. 10, when the detection region D is scanned forward, the hair ends of the plurality of flocking hairs M are in a state of intersecting the detection region D, and the three-dimensional positions of the hair ends of the respective flocking hairs M can be detected.

[Head]

Figure 13:
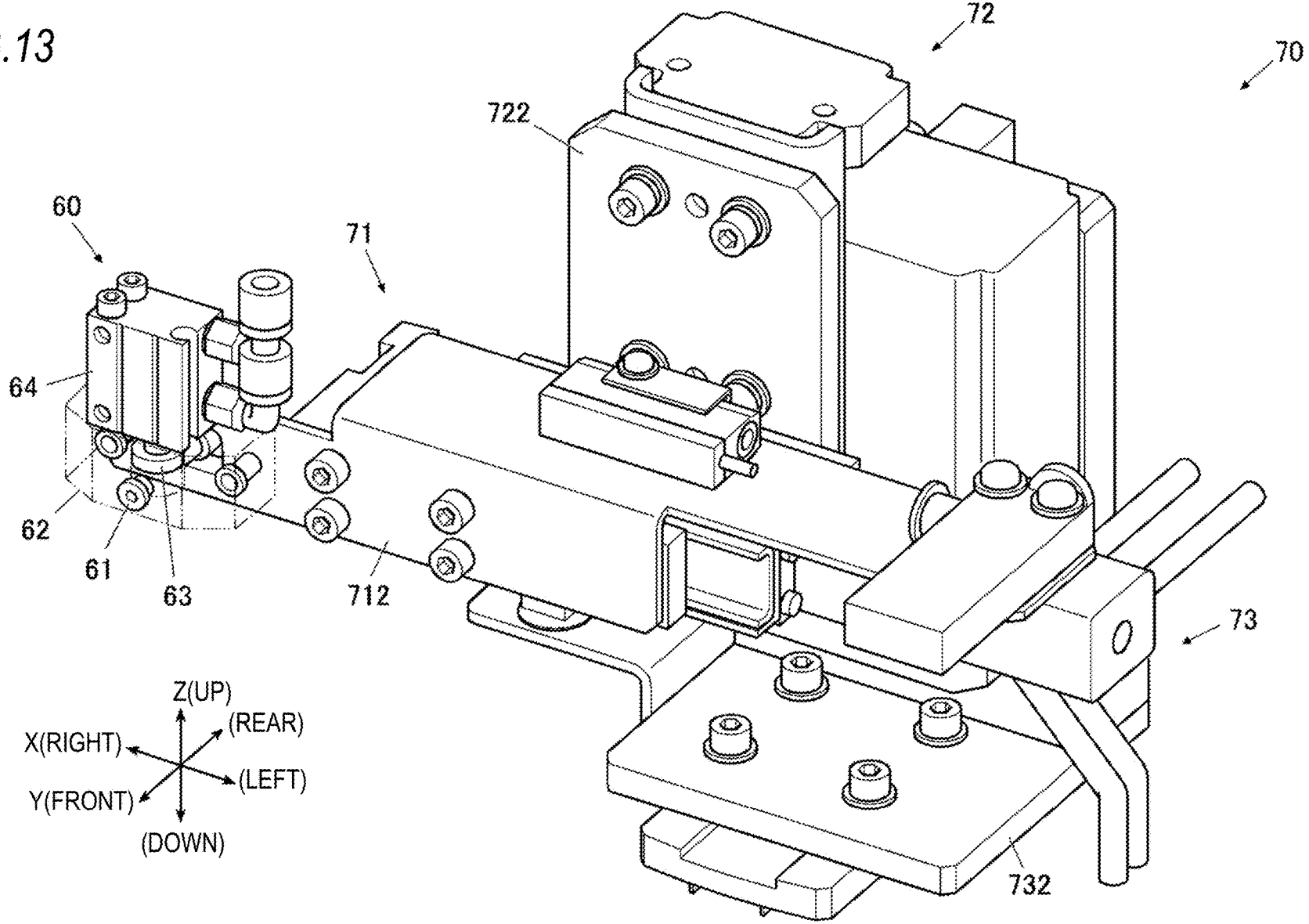
FIG. 13 is a perspective view of the head and a conveyance mechanism.
Figures 14A, 14B, 14C:
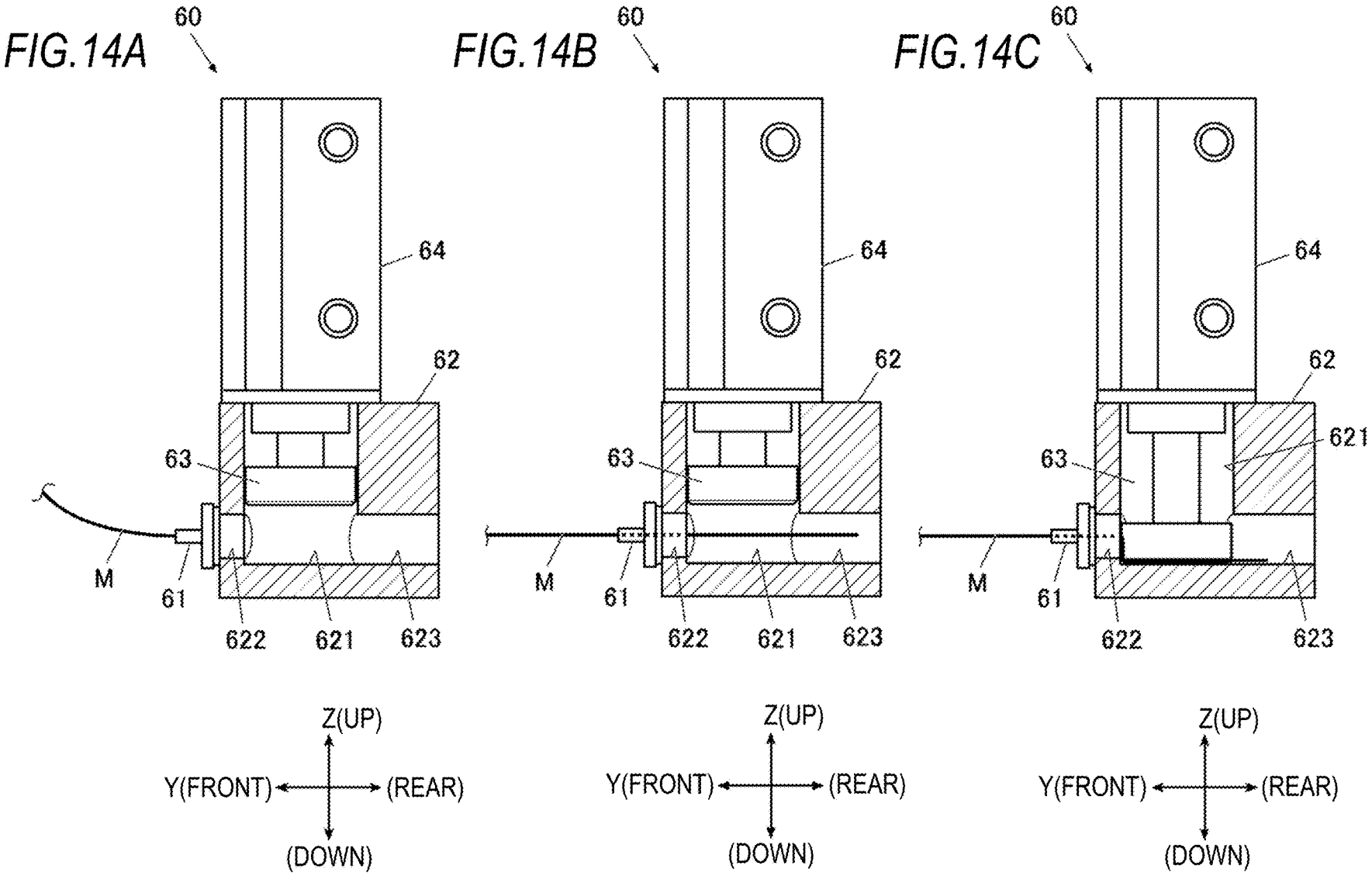
FIGS. 14A to 14C are sectional views illustrating a suction operation of the flocking hair by the head in order.

FIG. 13 is a sectional view of the head 60 and the conveyance mechanism 70, and FIGS. 14A to 14C are sectional views illustrating a suction operation of the flocking hair by the head 60.

The head 60 that holds the hair end of the flocking hair M is supported by the conveyance mechanism 70, and the head 60 and the conveyance mechanism 70 are arranged behind the feeder 20.

The head 60 includes: a nozzle 61 that suctions the hair ends of the flocking hairs M; a nozzle casing 62 that forms an air chamber connected to the nozzle 61; a gripping member 63 that grips the flocking hair M suctioned from the nozzle 61 into an air chamber 621 of the nozzle casing 62; and a first gripping air cylinder 64 that serves as an actuator that gives a gripping pressure to the gripping member 63.

The nozzle 61 is a tubular body having an inner diameter through which the flocking hair M can be inserted with a certain margin. The opening portion on the front end side may have a shape in which the outer diameter widens slightly forward.

The nozzle casing 62 includes: the air chamber 621 formed of a circular bottomed hole including an open upper portion and a constant inner diameter; an attachment hole 622 of the nozzle 61 penetrating the air chamber 621 from the outside of the front end; and an intake hole 623 that penetrates the air chamber 621 from the outside of the rear end and is connected to a negative pressure source formed of an ejector or a pump. The intake hole 623 is connected to an intake path (not illustrated) including an electromagnetic valve 61*a* (refer to FIG. 3) that switches between a suction state by a negative pressure source and a suction stop state.

Inside the air chamber 621, a cylindrical or disk-shaped gripping member 63 that can reciprocate in the up-down direction in the air chamber 621 is stored.

The gripping member 63 is connected to the plunger of the first gripping air cylinder 64 provided above the nozzle casing 62.

The first gripping air cylinder 64 is fixedly mounted above the nozzle casing 62 while the plunger is oriented downward. A sealing material (not illustrated) having airtightness is inserted between the first gripping air cylinder 64 and the nozzle casing 62 to prevent the inflow of outside air from the upper opening portion into the air chamber 621.

The first gripping air cylinder 64 can be switched between a state (FIGS. 14A and 14B) where the gripping member 63 is retracted upward and a state (FIG. 14C) of being pressed against the bottom portion of the air chamber 621, in the air chamber 621.

Accordingly, it is possible for the gripping member 63 to grip the flocking hair M suctioned from the nozzle 61 into the air chamber 621.

A flow meter 625 (refer to FIG. 3) that serves as a flow rate detector is provided between the air chamber 621 and an intake source, and the nozzle 61 detects the intake flow rate when suctioning the flocking hair M. The control device 100 can determine whether the nozzle 61 suctions one flocking hair M, does not suction at all, or suctions two flocking hairs M, based on the detected flow rate of the flow meter 625.

[Conveyance Mechanism]

Figure 15:
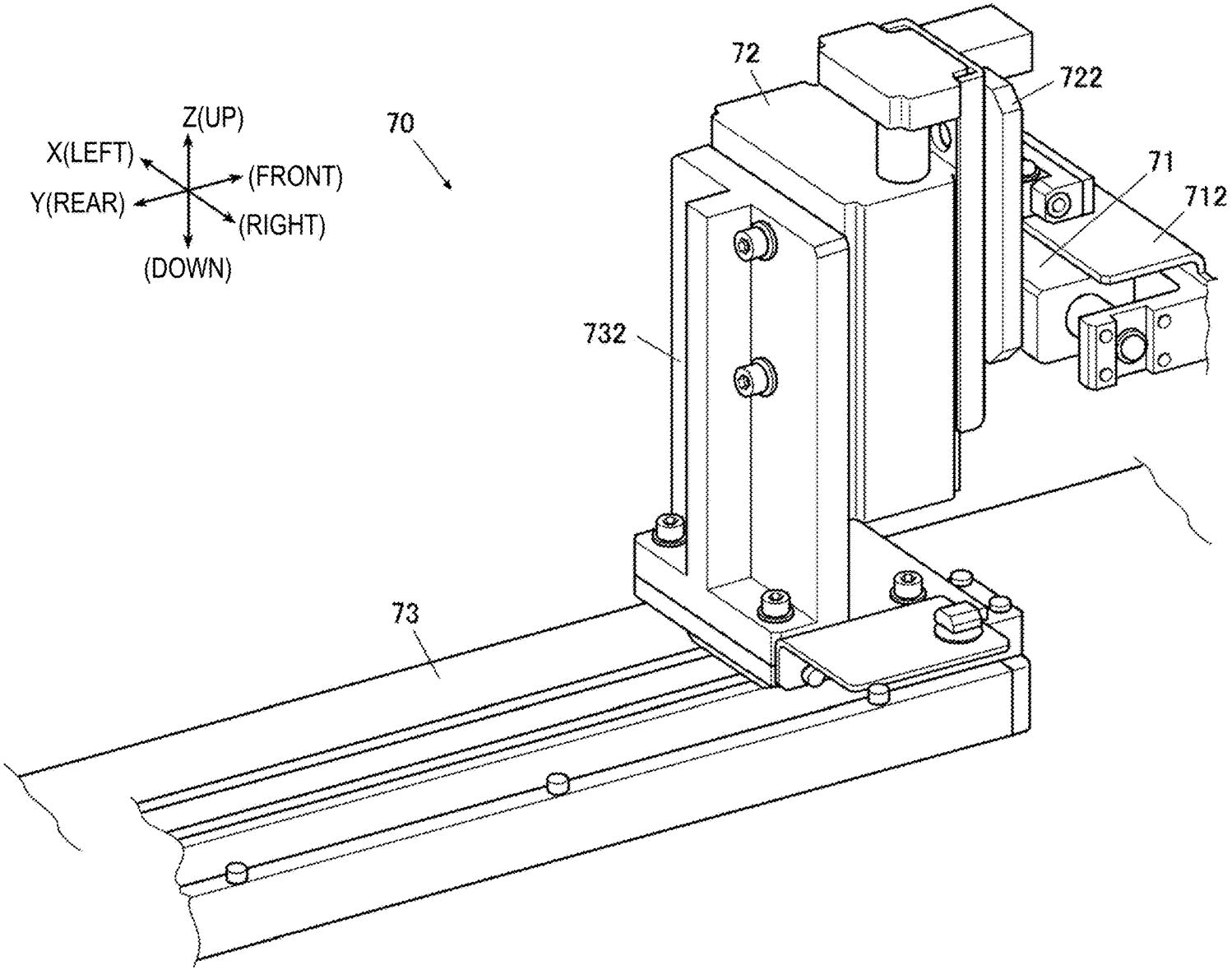
FIG. 15 is a perspective view of the conveyance mechanism when viewed from a direction different from that in FIG. 13.

FIG. 15 is a perspective view of the conveyance mechanism 70 when viewed from a direction different from that in FIG. 13. As illustrated in FIGS. 13 and 15, the conveyance mechanism 70 includes: an X-axis conveying unit 71 that conveys the head 60 along the X-axis direction; a Z-axis conveying unit 72 that conveys the head 60 along the Z-axis direction via the X-axis conveying unit 71; and a Y-axis conveying unit 73 that conveys the head 60 along the Y-axis direction via the X-axis conveying unit 71 and the Z-axis conveying unit 72.

The X-axis conveying unit 71 includes, for example, the ball screw mechanism and an X-axis conveying motor 711 (refer to FIG. 3) that serves as a driving source thereof. By driving the X-axis conveying motor 711, a bracket 712 that supports the head 60 moves along the X-axis direction, and the head 60 can be moved and positioned at any position in the X-axis direction.

Similarly, the Z-axis conveying unit 72 includes, for example, the ball screw mechanism and a Z-axis conveying motor 721 (refer to FIG. 3) that serves as a driving source thereof. By driving the Z-axis conveying motor 721, a bracket 722 that supports the X-axis conveying unit 71 moves along the Z-axis direction, and the head 60 can be moved and positioned at any position in the Z-axis direction.

The Y-axis conveying unit 73 includes, for example, the ball screw mechanism and a Y-axis conveying motor 731 (refer to FIG. 3) that serves as a driving source thereof. By driving the Y-axis conveying motor 731, a bracket 732 that supports the Z-axis conveying unit 72 moves along the Y-axis direction, and the head 60 can be moved and positioned at any position in the Y-axis direction.

The X-axis conveying unit 71 and the Z-axis conveying unit 72 are exclusively used in positioning for suctioning the hair ends of the flocking hairs M by the head 60. On the other hand, in addition to the positioning for suctioning the hair ends of the flocking hairs M by the head 60, when the head 60 grips the flocking hair M, the Y-axis conveying unit 73 is also used for the pull-out operation for pulling out the flocking hair M from the bundle B, and thus, the movable range is set to be wider than the X-axis conveying unit 71 and the Z-axis conveying unit 72.

The X-axis conveying unit 71, the Z-axis conveying unit 72, and the Y-axis conveying unit 73 may be capable of moving and positioning the head 60 at any three-dimensional position, and each of the units 71, 72, and 73 may use a well-known linear motion mechanism other than the ball screw mechanism.

[Gripping Device]

Figure 16:
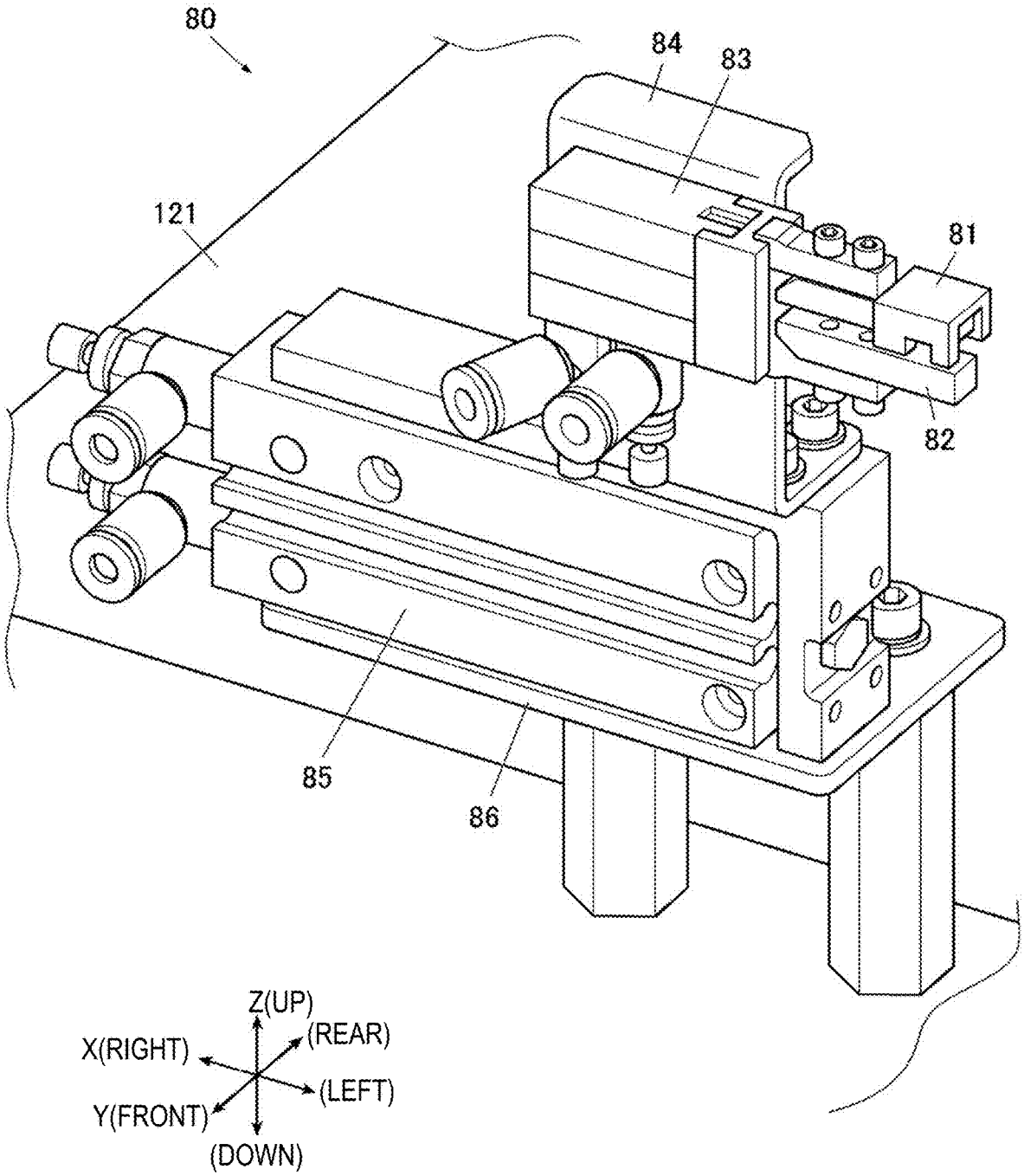
FIG. 16 is a perspective view of a gripping device.

FIG. 16 is a perspective view of the gripping device 80. As illustrated in FIGS. 1, 2, and 8, the gripping device 80 is disposed behind the feeder 20 and the detector 50, and slightly to the right side of the movable region of the head 60 in the Y-axis direction by the conveyance mechanism 70.

The gripping device 80 includes: the gripping device 80 that grips the end portion on the opposite side of the hair end of the flocking hair M captured by the head 60; an upper gripping member 81 and a lower gripping member 82 which grip the flocking hair M; a second gripping air cylinder 83 that raises and lowers the upper gripping member 81; a gripping member support bracket 84 that supports the second gripping air cylinder 83, the upper gripping member 81, and the lower gripping member 82; a retracting air cylinder 85 that moves the upper gripping member 81 and the lower gripping member 82 along the X-axis direction via the gripping member support bracket 84; and a base 86 that supports the overall configuration of the gripping device 80.

The lower gripping member 82 is fixedly supported by the gripping member support bracket 84, and the upper gripping member 81 is supported to perform a raising and lowering operation with respect to the gripping member support bracket 84 via the second gripping air cylinder 83.

The lower gripping member 82 extends to the left from the vicinity of the upper end portion of the gripping member support bracket 84, and the upper surface of the left end portion serves as a gripping surface for gripping the flocking hair M.

The upper gripping member 81 extends to the left in the vicinity of the upper end portion of the gripping member support bracket 84, that is, at a position immediately above the lower gripping member 82, and the lower surface of the left end portion serves as a gripping surface for gripping the flocking hair M.

When a lowering operation by the second gripping air cylinder 83 is given, the gripping surface of the upper gripping member 81 is pressed against the gripping surface of the lower gripping member 82, and the upper gripping member 81 can grip the flocking hair M between the gripping surfaces.

The gripping surface of the upper gripping member 81 is elastically supported in the Z-axis direction, or the gripping surface itself is made of an elastic material. Therefore, when the flocking hair M is pulled with a certain tension in a state where the flocking hair M is gripped by the upper gripping member 81 and the lower gripping member 82, the flocking hair M can be moved while sliding.

The delivery position of the head 60 with respect to the gripping device 80 is a position where the center of the nozzle 61 is on the Y-axis line passing through the upper end portion of the narrow portion 333 of the receiving plate 33, and is a position where the tip end portion of the nozzle 61 is positioned slightly behind the gripping position in the upper gripping member 81 and the lower gripping member 82 of the gripping device 80.

Accordingly, in a state where the head 60 grips the rear end portion of the flocking hair M and the gripping device 80 grips the flocking hair M at a position in front of the gripping position of the head 60, as the conveyance mechanism 70 makes the head 60 move retreat to the extension position, a state where the flocking hairs M are stretched with a constant tension over almost the entire length while sliding the gripping surfaces of the upper gripping member 81 and the lower gripping member 82 can be achieved.

The second gripping air cylinder 83 is supported by the gripping member support bracket 84 in a state where the plunger is oriented upward, and the plunger is connected to the upper gripping member 81.

The base 86 is arranged on the upper surface of the support plate 121 behind and on the right side of the detector 50.

The retracting air cylinder 85 is placed and mounted on the upper portion of the base 86 while the plunger thereof is oriented leftward, and supports the gripping member support bracket 84 connected to the plunger on the upper side of the left end portion.

The retracting air cylinder 85 can move the upper gripping member 81 and the lower gripping member 82 along the X-axis direction between the retracting position which is the right end portion of the movable region and the gripping position which is the left end portion via the gripping member support bracket 84.

At the retracting position, the upper gripping member 81 and the lower gripping member 82 are on the right outside of the movable region of the head 60, and a state of being retracted to a position where the interference with the head 60 conveyed by the conveyance mechanism 70 does not occur is achieved.

At the gripping position, the upper gripping member 81 and the lower gripping member 82 are at a position where it is possible to grip the flocking hairs M along the Y-axis direction, which are stretched rearward from the upper end portion of the narrow portion 333 of the receiving plate 33 of the bundle holder 30.

[Control System of Hair Feeding Device]

As illustrated in FIG. 3, the control device 100 of the hair feeding device 10 includes: a read only memory (ROM) 102 that stores a program for the performing the operation control that automatically takes out and feeds the flocking hairs M one by one from the bundle B of the flocking hairs M to the hair flocking device (not illustrated); a random access memory (RAM) 103 that serves as a work region for arithmetic processing; a rewritable non-volatile data memory 104 that serves as a storage unit for storing various pieces of setting data and the like; and a central processing unit (CPU) 101 that executes the program in the ROM 102.

The CPU 101 controls the drive of the sensor conveying motor 53, the X-axis conveying motor 711, the Z-axis conveying motor 721, and the Y-axis conveying motor 731 via motor drive circuits 53*a*, 711*a*, 721*a*, and 731*a*.

The CPU 101 is connected to drive circuits 36*b*, 44*b*, 48*b*, 64*b*, 83*b*, and 85*b* for controlling electromagnetic valves 36*a*, 44*a*, 48*a*, 64*a*, 83*a*, and 85*a* that operate each of the holding air cylinder 36, the advancing air cylinder 44, the rotating air cylinder 48, the first gripping air cylinder 64, the second gripping air cylinder 83, and the retracting air cylinder 85.

The CPU 101 is connected to the electromagnetic valve 49*a* that discharges air from the air nozzle 49, and drive circuits 49*b* and 61*b* for controlling the electromagnetic valve 61*a* that switches between a suction state and a suction stop state of the head 60.

The CPU 101 is connected to the light source 511 and the light receiving element 512 of the displacement sensor 51, and the flow meter 625 via the interfaces 51*a* and 625*a*.

The CPU 101 is connected to the pedal 14 that starts the feeding operation of the flocking hair M via the interface 14*a*.

The CPU 101 is connected to an operation panel 15 having a function as a display unit for displaying various pieces of information and a function as an input unit for performing various inputs, via the interface 15*a*.

[Control of Operation of Feeding Flocking Hair]

Figure 17:
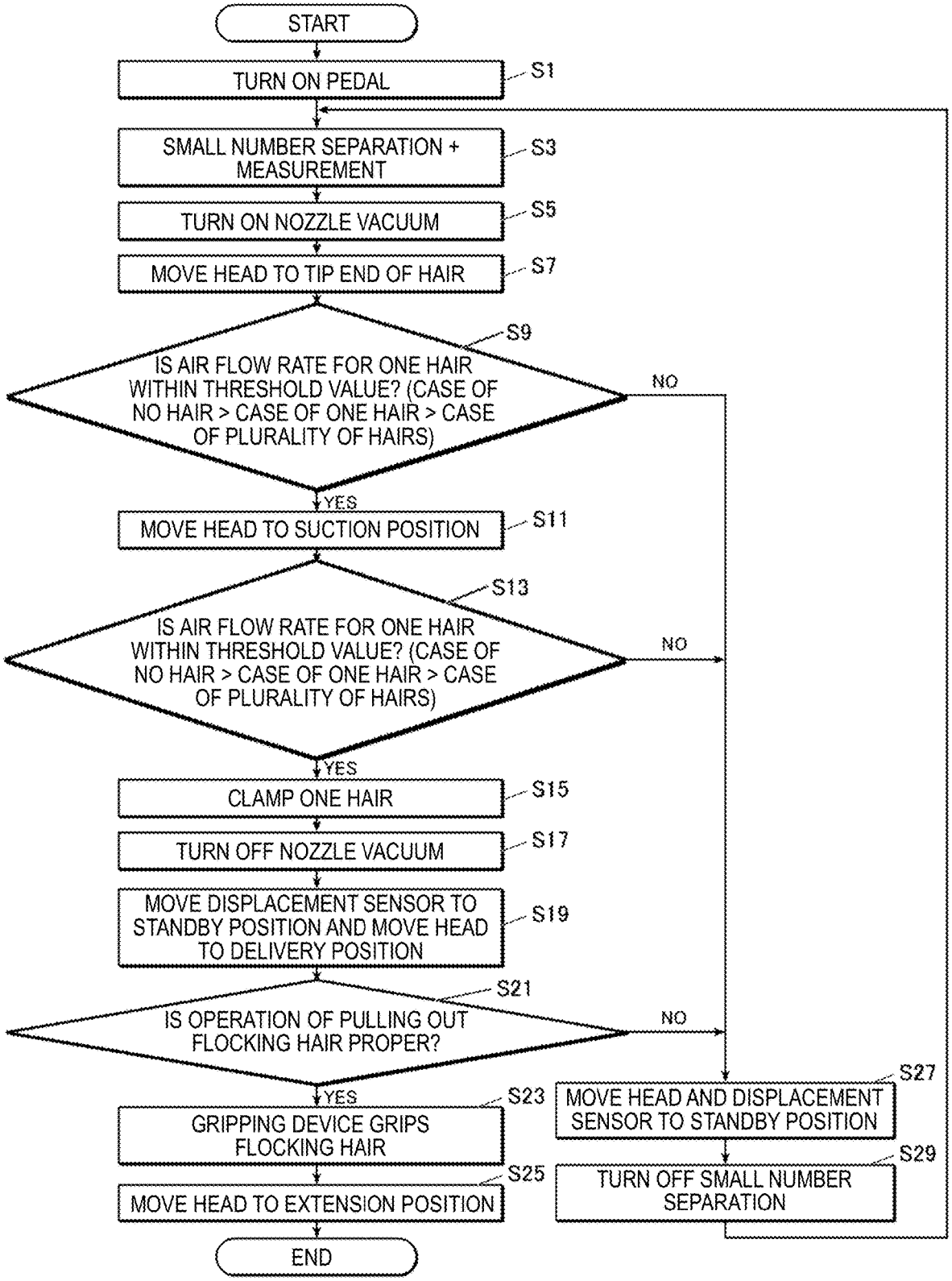
FIG. 17 is a flowchart of an operation control in which the flocking hairs are automatically taken out one by one from a bundle of flocking hairs and fed to the hair flocking device.

FIG. 17 is a flowchart of an operation control in which the flocking hairs M are automatically taken out one by one from the bundle B of the flocking hairs M and fed to the hair flocking device (not illustrated). Hereinafter, the feeding operation control of the flocking hair M will be described in detail.

In the feeder 20, it is assumed that, by the operation of the holding air cylinder 36, the bundle B of the flocking hairs M is sandwiched between the abutting surface 331 of the receiving plate 33 and the cutout portion 341 of the pressure plate 34.

In such a state, when the input of the start of the feeding operation by the pedal 14 is detected (step S1), the CPU 101 executes the operation (small number separation) of separating the hair ends of the plurality of flocking hairs M by the separation plate 41 in a state where the hair ends are oriented rearward and a measurement operation of the position of the separated hair end of the flocking hair M (step S3).

In other words, from the state illustrated in FIG. 5, the separation plate 41 is moved to advance to the right by the advancing air cylinder 44, penetrates into the part pushed to the narrow portion 333 of the bundle B of the flocking hairs M, and separates the plurality of flocking hairs M. As illustrated in FIG. 6, the separation plate 41 is rotated by 90° by the rotating air cylinder 48 and pushed down so that the separated hair ends of the plurality of flocking hairs M are oriented rearward, and by blowing air from below by the air nozzle 49, the plurality of flocking hairs M that have been pushed down are dispersed to not overlap each other.

In a state where the displacement sensor 51 receives and emits the light, the sensor conveying motor 53 moves the displacement sensor 51 to advance from a standby position where the detection region D is sufficiently at the rear part to the extent that the hair end of the flocking hair M oriented rearward does not normally reach, to the stop position where the detection region D is in the vicinity of the narrow portion 333. The distance from the standby position to the stop position is set to be equal to or less than the distance at which the detection region D at the stop position reaches the narrow portion 333.

Accordingly, as illustrated in FIG. 10, the detection region D along the X-Z plane of the displacement sensor 51 moves to advance, and the positions of the hair ends of the plurality of flocking hairs M that have intruded the detection region D on the X-Z plane are detected. Here, since the displacement sensor 51 is moving to advance, the position on the X-Z plane is continuously detected at a sampling interval of a minute time, and accordingly, the three-dimensional positions of the hair ends of the plurality of flocking hairs M can be acquired.

When the three-dimensional positions of the hair ends of the plurality of flocking hairs M are detected, only one flocking hair M among the plurality of flocking hairs M is selected. For example, the CPU 101 selects the flocking hair M of which the hair end extends to the rearmost position (head 60 side).

The selection of the flocking hair M is not limited to the above, and any method of selecting one from the plurality of hairs can be selected. For example, among the plurality of flocking hairs M, the flocking hair M having the smallest gradient with respect to the Y-axis direction may be selected.

There are cases where the number of flocking hairs M of which the three-dimensional positions are detected is only one, but here, the selection process may not be performed.

In rare cases, there can be a case where the three-dimensional position of the hair end of the flocking hair M is not detected at all, but here, the CPU 101 may perform error processing such as notification. Otherwise, the separation operation may be retried by advancing and rotating the separation plate 41.

When the flocking hair M is selected, the CPU 101 controls the electromagnetic valve 61*a* to start suction at the nozzle 61 of the head 60 (step S5).

The CPU 101 controls the X-axis conveying motor 711, the Z-axis conveying motor 721, and the Y-axis conveying motor 731, and conveys the head 60 which is at the standby position so that the tip end position of the nozzle 61 is positioned at the detected position of the selected hair end of one flocking hair M (step S7).

The standby position of the head 60 may be a position where the tip end position of the nozzle 61 is sufficiently at the rear part to the extent that the hair end of the flocking hair M oriented rearward does not normally reach, but here, further, the center of the nozzle 61 is positioned on the Y-axis line passing through the upper end portion of the narrow portion 333 of the receiving plate 33.

When the head 60 reaches the hair end of the one selected flocking hair M, the CPU 101 executes a confirmation control for determining whether one flocking hair M is suctioned by the nozzle 61 from the detected flow rate of the flow meter 625 (step S9).

Regarding the flow rate in the nozzle 61, based on the actually measured value or the like, a lower limit threshold value and an upper limit threshold value for taking out the flow rate when one flocking hair M is suctioned by the nozzle 61 are determined in advance, and the above-described determination is performed based on whether the detected flow rate is within the range from the lower limit threshold value to the upper limit threshold value. The threshold values may be recorded in the data memory 104 in advance, or may be set to any value from the operation panel 15.

If the detected flow rate is out of the range from the lower limit threshold value to the upper limit threshold value (step S9: NO), the CPU 101 stops suction and returns the head 60 and the displacement sensor 51 to the respective standby positions (step S27), and further executes the operation control for returning the separation plate 41 to a standby state (step S29).

The process is returned to step S3, and the operation (small number separation) of separating the flocking hair M, the operation of measuring the position of the hair end of the flocking hair M, and the operation of suctioning one flocking hair M by the head 60 are retried.

Meanwhile, if the detected flow rate is within the range from the lower limit threshold value to the upper limit threshold value (step S9: YES), the CPU 101 controls the conveyance mechanism 70 so that the head 60 moves to advance to the suction position (step S11).

The suction position of the head 60 is a position where the center of the nozzle 61 is on the Y-axis line passing through the upper end portion of the narrow portion 333 of the receiving plate 33, and is a position moved to advance by the prescribed distance from the hair end position of the flocking hair M. The prescribed distance is a distance at which the hair end of the flocking hair M suctioned by the nozzle 61 can be inserted into the air chamber 621 to a position where the gripping member 63 can grip the hair end.

The CPU 101 re-executes the same confirmation control as that in step S9 at the suction position of the head 60 (step S13).

Here, if the detected flow rate is out of the range from the lower limit threshold value to the upper limit threshold value (step S13: NO), the process proceeds to step S27, and separation of the flocking hair M from the bundle B, detection of the hair end, and suction of the flocking hair M are retried.

If the detected flow rate is within the range from the lower limit threshold value to the upper limit threshold value (step S13: YES), the CPU 101 controls the first gripping air cylinder 64 to lower the gripping member 63, grips the hair end of the flocking hair M in the air chamber 621 (step S15), and controls the electromagnetic valve 61*a* to end the suction by the nozzle 61 of the head 60 (step S17).

Next, the CPU 101 returns the displacement sensor 51 to the standby position and moves the head 60 to the delivery position with respect to the gripping device 80 (step S19).

The delivery position of the head 60 with respect to the gripping device 80 is a position where the center of the nozzle 61 is on the Y-axis line passing through the upper end portion of the narrow portion 333 of the receiving plate 33, and is a position where the tip end portion of the nozzle 61 is positioned slightly behind the gripping position in the upper gripping member 81 and the lower gripping member 82 of the gripping device 80.

When the head 60 is moved to the delivery position with respect to the gripping device 80, the gripped flocking hair M is pulled out immediately from the upper end portion of the narrow portion 333 of the receiving plate 33 along the Y-axis direction, and thus, it is possible to maintain the arrangement in which the flocking hair M passes through the detection region D of the displacement sensor 51 until the hair reaches the delivery position at the delivery position.

Therefore, the CPU 101 detects the flocking hair M that has passed through the detection region D by the displacement sensor 51, and determines the suitability of the pull-out operation of the flocking hair M (step S21).

In other words, by the detection of the displacement sensor 51, it is determined whether the section of one flocking hair M is detected at a proper position.

For example, it is determined that the pull-out operation is not proper if the gripped flocking hairs M are released and the flocking hairs M are not detected in the detection region D, the flocking hairs M are released from the gripped state and the flocking hairs M are detected at an apparently abnormal position, the plurality of flocking hairs M are gripped and the section of the plurality of hairs are detected, or the like.

If it is determined that the pull-out operation is not proper (step S21: NO), the gripping state is released, the process proceeds to step S27, and separation of the flocking hair M from the bundle B, detection of the hair end, and suction of the flocking hair M are retried.

If it is determined that the pull-out operation is proper (step S21: YES), the CPU 101 controls the retracting air cylinder 85 of the gripping device 80 to move the upper gripping member 81 and the lower gripping member 82 from the retracting position thereof to the gripping position, and controls the second gripping air cylinder 83 to grip the flocking hair M by the upper gripping member 81 and the lower gripping member 82 (step S23).

The CPU 101 controls the conveyance mechanism 70 so that the head 60 moves to retreat to the extension position (step S25), and ends the feeding operation control of the flocking hair M.

The extension position of the head 60 is a position moved from the above-described delivery position rearward by a distance slightly shorter than the length obtained by subtracting the gripping allowance of the gripping device 80 and the gripping allowance of the head 60 from the length of the flocking hair M. The length of the flocking hair M, the gripping allowance of the gripping device 80, and the gripping allowance of the head 60 may be recorded in advance in the data memory 104 or may be settable in advance from the operation panel 15 as setting data.

By conveying the head 60 to the extension position, the flocking hair M is stretched over almost the entire length between the gripping device 80 and the head 60, and it is possible to deliver the flocking hair M to the hair flocking device (not illustrated).

In the feeding operation control of the flocking hair M, the head 60 in step S25 may be added with additional process without ending with the retreating movement to the extension position.

For example, in a stretched state of step S25, the electromagnetic valve 61*a* is controlled to bring the nozzle 61 into a suction state, and the first gripping air cylinder 64 is controlled to release the gripping state of the gripping member 63.

The flow meter 625 detects that the flocking hair M which is in a stretched state is taken up by the hair flocking device (not illustrated), and the flocking hair M in the nozzle 61 of the head 60 is pulled out.

Thereby, the suction of the nozzle 61 is stopped, the gripping state of the gripping device 80 is released, the upper gripping member 81, the lower gripping member 82, and the head 60 are returned to the respective standby positions, and then the feeding operation control of the flocking hair M may be ended.

Accordingly, when it is necessary to feed the next flocking hair M, the feeding operation of the next flocking hair M can be started promptly, and the continuous feeding of the flocking hairs M can be performed.

[Technical Effects of Embodiment]

In the hair feeding device 10, the feeder 20 separates the hair ends of the plurality of flocking hairs M from the bundle B of the flocking hairs M rearward, and the CPU 101 of the control device 100 controls the conveyance mechanism 70 so that the head 60 captures the hair ends of the flocking hairs M at the three-dimensional position of the hair end of one flocking hair M among the plurality of hairs detected by the detector 50.

Therefore, one flocking hair M can be automatically taken out from the bundle B of the flocking hairs M, and the flocking hairs M can be stably fed to the hair flocking device one by one.

In the hair feeding device 10, the detector 50 is configured to perform scanning using the displacement sensor 51 for detecting the two-dimensional position along the direction in which the hair ends of the plurality of flocking hairs are oriented, and detect the three-dimensional positions of the hair ends of the plurality of the flocking hairs.

Therefore, with a relatively simple configuration, it is possible to realize excellent three-dimensional detection with high accuracy.

The CPU 101 of the control device 100 controls the conveyance mechanism 70 so that the flocking hair M captured by the head 60 passes through the detection region D of the displacement sensor 51 and is pulled out from the bundle B.

Therefore, even after the flocking hair M is pulled out by the head 60, it is possible to determine whether one flocking hair is properly pulled out by the detection of the detector 50, and it is possible to reduce the occurrence of conveyance failure, and to feed the flocking hair M more stably.

The CPU 101 of the control device 100 controls the conveyance mechanism 70 to select and hold the flocking hair M most extended to the head 60 side from among the plurality of flocking hairs M in a state where the hair ends are oriented in a direction different from that of the bundle B.

Therefore, it is possible to properly select one flocking hair M from among the plurality of selected flocking hairs M.

When the flocking hair M that extends most to the head 60 is selected, the flocking hair M can be easily captured by the head 60, and thus, it is possible to prevent the capture of two or more flocking hairs M, and to stably perform the feeding operation of the flocking hairs M.

In the hair feeding device 10, the feeder 20 includes: the bundle holder 30 that holds the bundle B of the flocking hairs M; and the separator 40 that separates the plurality of flocking hairs M from the bundle B of the flocking hairs M in a state where the hair ends are oriented in a direction different from that of the bundle B.

Accordingly, when feeding the flocking hair M, one flocking hair M may be taken out from the plurality of flocking hairs M, and thus, it is possible to much more easily feed the flocking hairs M one by one compared with the work of taking out one flocking hair M directly from the bundle B of the flocking hairs M.

The bundle holder 30 includes the receiving plate 33 on which the bundle B of the flocking hairs M is pressed against and held on the two abutting surfaces 331, and the separator 40 includes the separation plate 41 that is inserted into the part on the abutting surface 331 side (rear side) in the bundle B of the flocking hairs M and separates the plurality of flocking hairs M.

Therefore, regardless of the sectional shape of the bundle B of the flocking hairs M, it is possible to easily separate the plurality of flocking hairs M pushed into a narrow region between the two abutting surfaces 331.

Since the separation plate 41 performs an operation of rotating the flat plate surface 411 in a state of being inserted into the bundle B of the flocking hairs M when separating the flocking hair M, the plurality of flocking hairs M can be easily oriented in the direction different from that of the bundled B. Therefore, the hair ends of the plurality of flocking hairs M can be separated from the bundle B, and one flocking hair M can be easily captured from the plurality of flocking hairs M.

The direction of the hair ends of the plurality of flocking hairs M can be easily adjusted by the rotation angle of the separation plate 41.

On the flat plate surface 411, the separation plate 41 includes the recessed groove 412 that allows a state where the separated hair ends of each of the plurality of flocking hairs M are widened. Therefore, when the plurality of flocking hairs M are oriented in the direction different from that of the bundle B, when viewed from the direction orthogonal to the flat plate surface 411, it is possible to prevent overlap of each of the flocking hairs M and encourage the hairs to be separated. Therefore, it is possible to easily and stably take out one flocking hair M from the plurality of flocking hairs M.

In the hair feeding device 10, the head 60 includes: the gripping member 63 that grips the flocking hair M suctioned by the nozzle 61; and the first gripping air cylinder 64 that gives a gripping pressure to the gripping member 63. Therefore, it is possible to easily capture and firmly grip only one flocking hair M from among the plurality of hairs by the nozzle 61, and to more reliably pull out the flocking hair M from the bundle B.

Therefore, it is possible to feed one flocking hair M in an excellent and stable manner.

The CPU 101 of the control device 100 determines whether one flocking hair M is suctioned by the nozzle 61 from the detected flow rate of outside air suction from the nozzle 61 detected by the flow meter 625, and if one flocking hair M is not suctioned, the hair feeding device 10 executes the confirmation control for performing the re-suction operation.

Therefore, when the flocking hair M is captured by the head 60, it is possible to determine whether one flocking hair is properly pulled out, and it is possible to reduce the occurrence of conveyance failure, and to feed the flocking hair M more stably.

When the nozzle 61 is positioned at the three-dimensional position of the hair end of the flocking hair M detected by the detector 50 and the hair end of the flocking hair M is suctioned by the nozzle 61, the CPU 101 of the control device 100 performs the control of moving the head 60 to advance toward the feeder 20 to the position where the gripping member 63 can grip the suctioned flocking hair M by the conveyance mechanism 70. Therefore, it is possible to sufficiently suction the flocking hair M, to more reliably pull out one flocking hair M from the bundle B of the flocking hairs M, and to feed the flocking hair M more stably.

The above-described confirmation control is performed before and after the advancing movement of the head 60 when the hair end of the flocking hair M is suctioned by the nozzle 61. Therefore, at the start and end of suction of the flocking hair M, it is possible to determine whether one flocking hair is properly pulled out, and it is possible to reduce the occurrence of conveyance failure more effectively, and to feed the flocking hair M more stably.

The hair feeding device 10 includes the air nozzle 49 that performs the blowing of the air to the flat plate surface 411 after the rotation of the separation plate 41. Therefore, when the plurality of flocking hairs M are viewed from the direction orthogonal to the flat plate surface 411, it is possible to prevent overlap of each of the flocking hairs M and encourage the hairs to be separated, and thus, it is possible to stably take out one flocking hair M from the plurality of flocking hairs M.

What is claimed is:

1. A hair feeding device configured to perform a feeding operation for pulling out flocking hairs one by one from a bundle of flocking hairs, the device comprising:

a feeder configured to hold the bundle of flocking hairs and separate hair ends of a plurality of the flocking hairs in a direction different from that of the bundle;

a head configured to hold the hair ends of the flocking hairs;

a conveyance mechanism configured to convey the head; and a control device configured to perform an operation control of the feeding operation, wherein the feeder includes a bundle holder configured to hold the bundle of flocking hairs, and a separator configured to separate a plurality of the flocking hairs from the bundle of flocking hairs held by the bundle holder in a state where the hair ends of the plurality of the flocking hairs are oriented in a direction different from that of the bundle, wherein the separator includes a separation plate having a flat plate surface that is inserted from an outer periphery of the bundle of flocking hairs and separates the plurality of the flocking hairs, and wherein the separation plate includes a recess portion configured to allow a state where the hair ends of each of the plurality of the separated flocking hairs are widened on the flat plate surface.

2. The hair feeding device according to claim 1, wherein the bundle holder includes an abutting member in which the bundle of flocking hairs is pressed against and held on two abutting surfaces that intersect each other with a gradual decrease in distance.

3. The hair feeding device according to claim 2, wherein the separation plate makes the plurality of the flocking hairs oriented in a direction different from that of the bundle by an operation of rotating the flat plate surface in a state of being inserted into the bundle of flocking hairs.

4. The hair feeding device according to claim 3, further comprising:

an air nozzle configured to blow air onto the flat plate surface that is in contact with the plurality of the flocking hairs after the rotation of the separation plate.

5. The hair feeding device according to claim 3, further comprising:

an air nozzle configured to blow air onto the flat plate surface that is in contact with the plurality of the flocking hairs after the rotation of the separation plate.

* * * * *